US011648454B2

(12) United States Patent
Wisniewski

(10) Patent No.: US 11,648,454 B2
(45) Date of Patent: May 16, 2023

(54) MOUTH GUARD

(71) Applicant: John F. Wisniewski, Glen Allen, VA (US)

(72) Inventor: John F. Wisniewski, Glen Allen, VA (US)

( * ) Notice: Subject to any disclaimer, the term of this patent is extended or adjusted under 35 U.S.C. 154(b) by 312 days.

(21) Appl. No.: 15/681,621

(22) Filed: Aug. 21, 2017

(65) Prior Publication Data

US 2018/0056167 A1 Mar. 1, 2018

Related U.S. Application Data

(60) Provisional application No. 62/378,472, filed on Aug. 23, 2016.

(51) Int. Cl.
*A63B 71/08* (2006.01)

(52) U.S. Cl.
CPC ..... *A63B 71/085* (2013.01); *A63B 2071/086* (2013.01); *A63B 2209/00* (2013.01)

(58) Field of Classification Search
CPC ..... A63B 71/085; A63B 2209/00; A63B 2071/086; A63B 2071/088; A61C 7/08; A61C 19/06; A61C 19/063; A61C 7/00; A61C 7/36; A61C 5/90; A61F 2005/563; A61F 13/00063; A61F 5/56
USPC ..... 128/861
See application file for complete search history.

(56) References Cited

U.S. PATENT DOCUMENTS 3,211,143 A * 10/1965 Grossberg ..... A63B 71/085 128/862
3,223,085 A * 12/1965 Gores ..... A63B 71/085 D24/176
3,314,423 A * 4/1967 Boatwright ..... A63B 71/085 128/861
3,682,164 A 8/1972 Miller
6,109,266 A * 8/2000 Turchetti ..... A63B 71/085 128/862
6,584,978 B1 * 7/2003 Brett ..... A63B 71/085 128/859

(Continued)

OTHER PUBLICATIONS

International Search Report dated Dec. 14, 2017 for International Application PCT/US2017/047737.

*Primary Examiner* — Ophelia A Hawthorne
*Assistant Examiner* — Kevin A Albers
(74) *Attorney, Agent, or Firm* — David S. Bradin; Nexsen Pruet, PLLC

(57) ABSTRACT

A mouth guard designed to minimize discomfort and speech interference associated with conventional mouthpieces is disclosed. The mouth guard has a substantially uniform thickness on the facial/buccal and biting surfaces of the anterior and posterior teeth, and along the lingual surface of the posterior teeth. The thickness of the mouth guard along the lingual surface of the anterior teeth is greater near the biting surface than near the gum line. This minimizes interference with the wearer's tongue, making it relatively easy to drink, speak, and breathe, while protecting the anterior and posterior teeth from impact from the front or underneath. The mouth guard can be a boil-and-bite or custom-made mouth guard, and can also include an impact shield, one or more power wedges or shock absorbers, a flavoring component, and/or an antibacterial component.

12 Claims, 22 Drawing Sheets

(56) References Cited

U.S. PATENT DOCUMENTS

| | | | | |
|---|---|---|---|---|
| 2007/0151568 | A1* | 7/2007 | Maurello | A63B 71/085 128/859 |
| 2009/0038624 | A1* | 2/2009 | Akervall | A63B 71/085 128/861 |
| 2010/0261133 | A1* | 10/2010 | Lax | A61C 9/0026 433/215 |
| 2011/0186055 | A1 | 8/2011 | Makkar et al. | |
| 2014/0261464 | A1* | 9/2014 | Layzell | A63B 71/085 128/861 |
| 2014/0345626 | A1* | 11/2014 | Brett | A63B 71/085 128/861 |
| 2014/0352704 | A1* | 12/2014 | Farrell | A63B 71/085 128/862 |
| 2017/0049607 | A1* | 2/2017 | Thornton | A61C 7/36 |

* cited by examiner

PRIOR ART

MOUTH GUARD

FIELD OF THE INVENTION

The present invention relates to a mouth guard, particularly suitable for athletes, that is specially designed to minimize discomfort and speech interference associated with conventional athletic mouth guards.

BACKGROUND OF THE INVENTION

Athletes commonly wear a mouthpiece on the upper teeth that redistributes the impact associated with blows to the jaw, mouth or chin, to protect teeth, the oral cavity, lips, jaw bones and the like. It may also be possible to protect against concussions by wearing a mouth guard.

A conventional mouthpiece includes a substantially U-shaped splint constructed with a moldable plastic. The mouthpiece includes a channel defined by an exterior side wall, a bottom wall, and an internal side wall. There are three main types of mouth guards, namely, stock mouth guards, mouth-formed mouth guards, and custom-made mouth guards, where some custom-made mouth guards are heat/vacuum formed and there are others that combine heat/vacuum formed with pressure lamination.

Stock mouth guards typically can be purchased at sporting goods stores, department stores and the like. These mouth guards may be made of rubber, polyvinyl chloride, or polyvinyl acetate copolymer, and are typically available in small, medium, and large sizes. These stock mouth guards are not in any way molded or "fit" to the persons wearing them and, as a result, can be loose and uncomfortable for the user. Often the mouth must be closed in order to hold them in place, and, not surprisingly, many athletes find them bulky and uncomfortable. In addition, these mouth guards can interfere with speech and breathing and the ability to drink, which are further strong disincentives for athletes to wear these mouth guards. The one benefit to these mouth guards is that they are inexpensive.

Mouth-formed mouth guards are fitted by the user. They are molded to fit the individual wearer either by using a moldable inner liner typically of plasticized acrylic gel or silicone rubber, or using a moldable thermoplastic that softens when immersed in boiling water, and sets when cooled. This thermoplastic mouth guard is also known as the "boil-and-bite" mouth guard. However, repeated biting during participation in athletic events or gnawing due to nervousness before or during an athletic event can cause the material to spread, resulting in a loose fit. In addition, aging and/or continual exposure to oral fluids may cause the plasticizers to leach out causing the liner to become hard.

While various materials are used to produce mouth guards, one used largely in these days is an ethylene-vinyl acetate copolymer (hereinafter sometimes abbreviated as EVA). In addition to these copolymers, other mouth guards are made of a polyolefinic rubber, silicone rubber, an ethylene-vinyl acetate copolymer supplemented with a thermoplastic polycaprolactone as disclosed in Japanese Patent Gazette No. 2594830.

Custom-made mouth guards are considered to be the best of the conventional mouth guards as far as fit, shape, retention and comfort are concerned, but they are also the most expensive. This type of mouth guard tends to not have the bulk of the other two types, and may stay in position better. Custom-made mouth guards are typically composed of a thermoplastic polymer, of which the most popular type is ethylene/vinyl acetate copolymer, although acrylic resin, polyurethane, and various rubber materials are also used. Custom-made mouth guards are fabricated by molding over a cast of a person's dentition, and most often this process is done by a dentist or in a dental laboratory. There are usually four steps required in the making of a custom-fit mouth guard: 1) making an impression of the maxillary arch; 2) pouring a cast; 3) forming the thermoplastic material on the cast; and 4) finishing the protector.

Mouth guards produced from EVA alone have a low impact absorbability, so these mouth guards are relatively thick (about 4 mm) in order to increase the impact absorption. However, when a user wears a mouth guard that is this thick, it is not easy to speak, and there can be some gagging. Gagging becomes pronounced, and speech becomes limited, when this uniform thickness extends over the facial/buccal, occlusal, and palatal surfaces of the teeth in conjunction with a typical extensive coverage over the hard palate. These considerations also make it difficult to breathe, provide a significant hindrance in the ability to drink, and the like.

Previous efforts at providing a mouth guard that makes it relatively easier to breathe and speak include the "Speak-easy" mouth pad, such as is described in U.S. Pat. No. 6,092,524. As disclosed in the Abstract of the '524 patent, the mouth guard includes a front wall which overlays a substantial portion of the front surface of the anterior teeth, but terminates at a predetermined distance from the lower edge of the anterior teeth. This design does allow the wearer's tongue to be free to engage the exposed lower edges and lingual surfaces of the anterior teeth, which purportedly enhances the wearer's ability to speak clearly while the mouth guard is being worn. Unfortunately, however, this design provides absolutely no protection in the event the wearer sustains a blow coming from an anterior to posterior direction at the unprotected facial portion, as well as the incisal edge and cusp tips of the anterior teeth. In addition, this design provides absolutely no protection in the event the wearer sustains a blow coming at an oblique angle from an inferior to a superior direction to unprotected facial portions, the incisal edges, cusp tips, and lingual surfaces (in close proximity to the incisal edges and cusp tips) of the anterior teeth. Finally, this design provides absolutely no protection in the event the wearer, with his/her mouth partially open, sustains a blow coming directly from an inferior to a superior direction to the unprotected facial portions, the incisal edges, cusp tips, and lingual surfaces (in close proximity to the incisal edges and cusp tips) of the anterior teeth. This last injury can be sustained when the wearer is hit with an object or just falls directly on the pavement (sidewalk, driveway, etc.) or onto the edge of a stair. The latter scenarios can occur during skate boarding, roller blading or scooter mishaps, or teeth hitting each other when the jaw is struck from underneath, similar to an upper cut motion when the mandible teeth are driven into the maxillary teeth.

The inventor of the '524 patent, noting this limitation, also filed U.S. Publication No. 20150224385, which purports to overcome this limitation by including a "labial connector," i.e. central bridge section, designed to overlay the incisal surfaces of the incisors and canines, not avoid them, while at the same time "optimizing protection to the wearer's tongue" (Background of the Invention). As described in paragraph [0016], and as shown in FIGS. 2 and 3, while the biting surface is covered, the anterior surface is not covered. Particularly with respect to boil and bite mouth guards, without covering at least a significant portion of the lingual surface of the anterior teeth, the mouth guard can move, allowing the top and bottom teeth to hit each other in the event of a hit from underneath the chin.

U.S. Pat. No. 8,925,554 to Hackman et al. discloses a mouth guard which only covers between about 5% and 30% of the lingual side of the upper central and lateral incisors, leaving at least about 70% to 95% of the length of the upper central and lateral incisors between the incisal edge and the gum line uncovered. While not wishing to be bound to a particular theory, it is believed that leaving this much of the lingual side of the upper central and lateral incisors uncovered can potentially subject these teeth to additional stresses in the event of impact.

It would be advantageous to provide an improved mouth guard that provides the ability to speak, breathe and drink with comfort, demonstrates a good fit and retention and is comfortable to wear.

It would also be advantageous to provide an improved mouth guard which provides the safety associated with covering all facial portions, the incisal edges, cusp tips, as well as the entire lingual surfaces of the anterior teeth in order to provide strength and to anchor the mouth guard.

The present invention provides such a mouth guard.

SUMMARY OF THE INVENTION

In one embodiment, the present invention is directed to a mouth guard, which protects the teeth, and allows the athlete to speak, breathe and drink comfortably. In one aspect of this embodiment, it is also comfortable to wear and/or fits well and is retained well once it is placed in the maxillary arch. These factors allow for the "typical sport" athlete to wear this particular mouth guard for extended periods of time (for example, two to three hours), without the need to insert and remove the mouth guard in between "each play" or "a brief series of plays."

In one embodiment, the mouth guard is a mouth-formed (i.e., boil-and-bite) mouth guard, and in another embodiment, the mouth guard is a custom-made mouth guard. In either embodiment, the mouth guard is designed to cover the entire front surface, all of the biting surface, and the lingual surface, of the anterior teeth as well as the posterior teeth as well as all of the distal and lingual surfaces of the posterior teeth.

The present invention is provides protection not only for the front surface of the front teeth, but also, provides protection to the incisal edge of the anterior teeth as well as the biting surface, of the posterior teeth. The lingual surface of the anterior teeth is also covered, though the material is relatively thicker where the lingual surface is adjacent to the incisal edge than where the lingual surface is adjacent to the gum line. In one aspect, the mouth guard terminates at the gingival cuff (i.e., the most coronal portion of the gingiva around the tooth) of the palatal tissue.

By covering the lingual surface of the anterior teeth, the mouth guard is stronger and more anchored in place relative to a mouth guard where only the incisal edge is covered, or only a portion, such as only 5 to 30%, of the lingual surface is covered. By narrowing the thickness of the material along the lingual surface, from a position adjacent to the incisal edge to a position near or adjacent to the gum line, the ability to speak, breathe, and drink is relatively unhindered. Further, the ability to protect the teeth from a blow coming from an anterior to posterior direction, a blow coming at an oblique angle from an inferior to a superior direction, when the wearer has his/her mouth partially open and sustains a blow coming directly from an inferior to a superior direction, or from hitting each other when the jaw is struck from underneath is significantly better than where only the incisal edge is covered.

This provides relatively improved protection, particularly when an anterior to posterior blow, a blow at an oblique angle from an inferior to a superior direction, or direct inferior to superior blow is received or when the bottom of the jaw is struck, driving the bottom teeth into the top teeth, while minimizing the impact on the ability to drink, speak, and breathe.

Regarding the shape and design of the mouth guard, in one aspect, the upper 3-4 mm, or roughly the upper third of the lingual/palatal surface from the incisal edge/cusp tip toward the gingiva has the same or substantially similar thickness as the portion of the mouth guard covering the front surface of the teeth, and the remaining palatal surface of the mouth guard is thinner than the portion of the mouth guard covering the front surface of the teeth. The thickness begins to change approximately one-third of the way from the incisal edge/cusp tip toward the gingiva, such that the thickness at the gingiva is between around 25% and around 35% of the thickness of the portion of the mouth guard covering the front surface of the teeth.

In another aspect, 40-50% of the lingual/palatal surface from the incisal edge/cusp tip toward the gingiva has the same or substantially similar thickness as the portion of the mouth guard covering the front surface of the teeth, and the remaining palatal surface of the mouth guard is thinner than the portion of the mouth guard covering the front surface of the teeth. The thickness begins to change around 40-50% of the way from the incisal edge/cusp tip toward the gingiva, such that the thickness at the gingiva is between around 25% and around 35% of the thickness of the portion of the mouth guard covering the front surface of the teeth.

In either aspect, the change in thickness can be linear or substantially linear, can be curved (i.e., concave), or any other suitable design. This unique feature of the mouth guard (i.e., the change in thickness on the lingual surface) allows the wearer to speak, breathe, and drink with comfort, at least in part because there is less obstruction to the wearer's tongue. Relative to a mouth guard where the thickness on the lingual side is the same as the thickness on the distal side, there is more space for the wearer's tongue to "fit" in the wearer's mouth, with less obstruction. However, by covering the entire lingual surface, rather than only a portion of the lingual surface, the mouth guard provides more protection in the case of impact.

The thickest portion of the mouth guard covers the majority of the facial aspect and the incisal edges and cusp tips of the anterior teeth and additionally from around 3-4 mm up to the incisal/cuspal one-third of the lingual surface of the anterior teeth. The thinnest portion of the portion of the mouth guard, which comes into contact with the lingual surface of the anterior teeth below the cingulum (or at the gingival margin) is, ideally, no less than around 25% and no more than around 35% of the thickness of the thickest portion of the mouth guard. The thickness of the remaining portion of the mouth guard covering the area in between these two before mentioned sections of lingual surfaces of the anterior teeth, ranges from initially approximately 50% to a value of between around 35% and 25% of the thickest portion of the mouth guard. The buccal, occlusal, and lingual/palatal surfaces of the premolars and molars are covered by mouth guard material similar in thickness to the thickest portion of the mouth guard. In one embodiment, not more than 4 mm, typically not more than 2 mm, and preferably not more than 1 mm of the palate itself is covered by the mouth guard. In one aspect of this embodiment, the coverage of the palate is only on that portion of the palate adjacent to the posterior teeth, not to the anterior teeth, and in another aspect, coverage of that portion of the palate adjacent the anterior teeth is less than 1 mm, and that portion of the palate adjacent to the posterior teeth is less than 4 mm.

In one embodiment, the mouth guard described herein is designed to be worn on the upper teeth, and, when the teeth are clenched, the bottom teeth fit inside a matching profile on the bottom side of the mouth guard. In another embodiment, the mouth guard is designed to be worn on the lower teeth, and, when the teeth are clenched, the top teeth fit inside a matching profile on the top of the mouth guard.

In one embodiment, the mouth guard is a boil-in-bite mouth guard. The material used in these mouth guards is thermoplastic, and the fit is obtained by allowing the material to flow while the wearer clenches down. As the mouth guard is fit, unless certain steps are taken ahead of time, the melted material might flow and create a fairly even thickness along the lingual surface of the anterior teeth. In one aspect of this embodiment, the mouth guard, before being fitted, exaggerates the transition in thickness, to account for some transfer of material while it is in the molten state. In another aspect of this embodiment, the material on the lingual surface of the anterior teeth is fairly even in thickness, but along the surface, is fitted with a quick-release sheet that lies between a portion of the material on this surface. After the mouth guard is fitted, and the quick-release sheet is pulled to release a portion of the material, the lingual surface will have the appropriate shape, whether linearly decreasing in thickness, decreasing in thickness along a concave curve, or some other shape profile, based on the shape of the portion of the material that is released and the portion of the material that is not released. In yet another aspect of this embodiment, if the lingual surface of the anterior teeth in the mouth guard as initially fitted includes a substantially even thickness, the surface can be shaped by holding the mouth guard and removing material on this surface by cutting, sanding, and the like. A curved or angled router blade, or similar bit attached to a Dremel® tool, can be sufficient to create this profile. To ensure a relatively even thickness, one can draw an appropriate curve along the anterior lingual surface, on the portion of the surface closest to the gumline, and trace this line with the Dremel® tool.

In another embodiment, the mouth guard is a custom-made mouth guard. The mouth guard is prepared by first taking an impression of the patient's teeth, and then prepared in a laboratory. Since the mouth guard is prepared outside of the patient's mouth, there is less of a concern about being able to create a difference in thickness. A desired profile can easily be prepared by a skilled dental laboratory, once they are instructed to include one. As with the boil-and-bite mouth guard, this can be accomplished by grinding away a certain amount of the thermoset material to create the profile, and, ideally, smoothing the ground surface to minimize irritation or discomfort caused by running the tongue against a less than smooth thermoset or thermoplastic surface.

Additional process steps can include thinning the buccal and facial borders, and extending them beyond the height of contour of the attached gingiva, and, optionally, making one or more "frenum reliefs." Further, in one aspect of this embodiment, the distal extensions cover the entire last maxillary molars (bilaterally) and seat firmly on the gingival tissue distal to the last upper molar. This can help seat the mouth guard in such a way that it is more difficult to dislodge by accident.

In various embodiments, the occlusal surfaces of the maxillary premolars and molars are covered in their entirety, the palatal surfaces of the maxillary premolars and molars are covered in their entirety, the incisal edges of the maxillary central and lateral incisors are covered in their entirety, the cusp tips of the maxillary canines are covered in their entirety, the gingival-palatal margins are "scalloped" to the gingival architecture, and combinations thereof, all while substantially maintaining the thickness of the mouth guard material.

In one embodiment, the mouth guard covers the palatal surface of the maxillary central and lateral incisors and the maxillary canines with a "ramp design". In aspect of this embodiment, the "ramp design" is fabricated with the following specifications.

40-50% of the lingual/palatal surface of the anterior teeth, from the incisal edge/cusp tip toward the gingiva has a thickness that is the same, or substantially the same, as the mouth guard has at the distal surface (covering the front of the teeth). The remaining 50-60% of the lingual/palatal surface of the maxillary central and lateral incisors and the maxillary canines is either concave or sloped (slanted), "thinning" to the gingival margin, and the gingival margins "scalloped" to the gingival architecture. Scalloping is shown, for example, in FIG. 9. This scalloping minimizes the amount of the mouth guard material coming into contact with the wearer's tongue, and, as such, adds to the comfort of the mouth guard.

In one embodiment, the custom-made mouth guards are constructed using a resilient conformable thermoplastic material such as that manufactured under the trademark ELVAX™ or any other similar equivalent. A mold is made of the wearer's upper teeth so that the mouthpiece described herein can be formed and molded according thereto and according to the details of construction enumerated above. After the mouth guard is formed according to a mold of the upper teeth, indentions can then formed on the inner surface of the front wall and on the upper surfaces of the bottom wall that subsequently accommodate the wearer's teeth.

In any of these embodiments, or aspects of these embodiments, the mouth guard can further include one or more "frenum reliefs." The labial frenum often attaches to the center of the upper lip and between the upper two front teeth. To avoid pain or irritation if the mouth guard hits the frenum, a slight gap can be created such that the mouth guard does not hit the frenum. Similarly, there are buccal frenum attachments in the right and left maxillary posterior muccobuccal fold areas. To avoid pain or irritation if the mouth guard impinges on the posterior buccal frenum attachments, a slight gap can also be created such that the mouth guard does not hit the frenum.

In various embodiments, the mouth guards can include one or more of elastomeric shock absorbers, power wedges, impact shields, antimicrobial components, and flavor components.

DETAILED DESCRIPTION

Figure 1A:
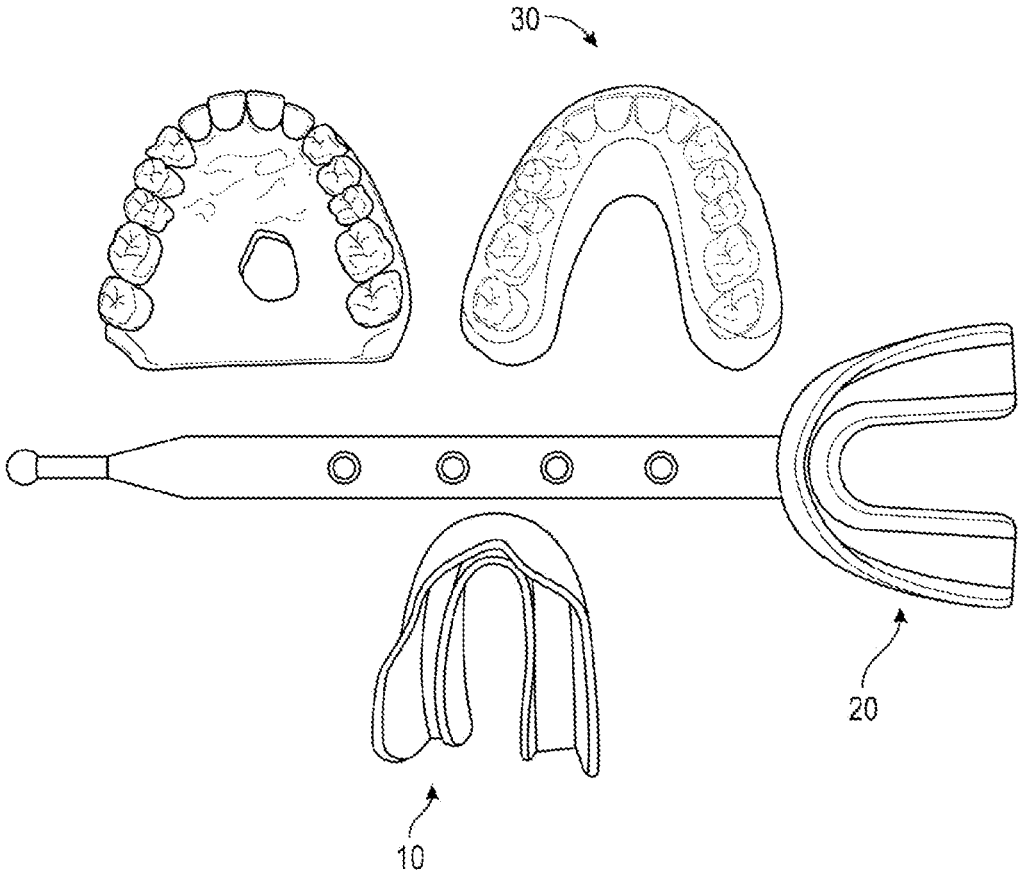
FIG. 1A is a schematic illustration showing a stock mouth guard (10), a store-bought "boil-and-bite" mouth guard (20), and a mouth guard custom-made by a dentist using a vacuum method (30).

In one embodiment, the invention relates to mouth guards which offer the user the opportunity to speak, breathe, and drink fluids more easily than when wearing a conventional mouth guard, while also providing adequate protection. Ideally, the mouth guard can be placed in a wearer's mouth and left in for extended periods of time, without the need for constant removal. The mouth guards can be worn by athletes and any other persons engaging in activities that potentially pose danger to the teeth.

The mouth guard can also be worn by, and be beneficial to, individuals who are not being exposed to potential dental trauma. Four such cases are the following: (1) Soccer players head the soccer ball at varying speeds and at different angles. Results of a study have shown that when manually clenching into a properly fitted, custom-made mouth guard, significant decreases in head acceleration and increases in masseter and sternocleidomastoid muscle activity were observed. This study concluded that dentists should encourage soccer players to habitually clench while wearing a proper mouth guard, to strengthen cervical muscle resistance as a way to mitigate the damage caused by "heading." ("Effect of Clenching with a Mouth guard on Head Acceleration during Heading of a Soccer Ball". Narimatsu, N., Takeda, T., Nakijima, K., Kommo, M., Ozawa, T., Ishigami, K. General Dentistry—Special Sports Dentistry Section, Pages 41-45, November/December 2015). (2) The mouth guard, because of its unique design, can be worn as a "nightguard" or a "biteguard" for individuals who grind and brux their teeth during the night OR for people who suffer from spasms of the muscles of mastication and/or TMJ problems. (3) Race car drivers who drive at high speeds can experience stress and tension in the supporting muscles of the neck due increases and decreases in centrifugal forces. By biting into a properly fitted custom-made mouth guard that muscles of the head and neck are strengthened. This can result in a decrease in the stress and tension in the supporting muscles of the neck due centrifugal forces. (4) Individuals in a state of "coma" can exhibit spontaneous grinding and chewing movements of the mandible. They can potentially cause damage to their oral soft tissues, for example, their lips, tongue, cheek and as well as their teeth. Fitting an individual/patient with this mouth guard will afford protection against these occurrences.

In one embodiment, the mouth guards include a mouth splint including a pair of posterior portions molded to receive and overlay the posterior teeth (premolars and molars). The posterior portions are interconnected with a front portion that overlays the anterior teeth (incisors and canines).

In one embodiment, the mouth guard includes a ramp design dimensioned to cover substantially the incisal edges of the maxillary incisors, cusp tips of the maxillary canines as well as all of both the front and back surfaces of the maxillary anterior teeth.

In one aspect of this embodiment, the ramp design is fabricated with the following specifications:

In one embodiment, between around 40 and around 50% of the lingual/palatal surface of the maxillary central and lateral incisors and the maxillary canines is covered, and the thickness of the mouth guard material is substantially maintained. As used herein, "substantially maintained" means a variation of no more than about 20% in thickness. In another embodiment, 3-4 mm to at most one-third (the incisal one-third) of the lingual/palatal surface of the maxillary central and lateral incisors and the maxillary canines is covered, and the thickness of the mouth guard material is substantially maintained.

The remaining palatal surface (in one embodiment, the "gingival two-thirds", and in the other embodiment, the remaining 50-60%) of the lingual/palatal surface of the maxillary central and lateral incisors and the maxillary canines is concave or sloped (slanted), "thinning" to the gingival margin, and the gingival-palatal margins are "scalloped" to the gingival architecture. The posterior portions each include an inner and outer wall. The outer wall is thinned and terminates in the anterior and posterior mucco-buccal fold for added retention, with the inner wall terminating with a "scalloped" design at the gum line.

These considerations can help minimize discomfort to the wearer.

The components of the mouth guards, and methods for making and using the mouth guards, are discussed in more detail below.

The present invention will be better understood with reference to the following definitions:

Definitions

Anterior: The direction towards the front of the head or the lips, as opposed to posterior, which refers to the directions towards the back of an individual's head. The term anterior teeth refers to incisors and canines, as opposed to premolars and molars, which are posterior teeth.

Apical: The direction towards the root tip(s) or apex(es) of a tooth (the apices), as opposed to coronal, which refers to the direction towards the crown. It may also refer to something relating to the roots, such as apical support. When referring to direction in relation to entities on or of the crown, this term can be synonymous with both cervical and gingival.

Axial: A plane parallel to the surface of a tooth. For example, if a drill bur would be inserted into a tooth from any side (proximal, vestibular, oral), the depth of the hole is defined from the axial wall of the hole (from the long axis walls (vertical surfaces bounding the tooth)).

Buccal: The side of a tooth that is adjacent to (or the direction towards) the inside of the cheek, as opposed to lingual or palatal (both oral), which refer to the side of a tooth adjacent to (or the direction towards) the tongue or palate, respectively, the oral cavity. Although technically referring only to posterior teeth (where the cheeks are present instead of lips, use of this term has incorrectly extended to all teeth, anterior and posterior), this term has inaccurately been employed to describe the vestibular surface of (or directions in relation to) anterior teeth as well.

Cervical: Means neck in Latin (as in cervical vertebrae), and refers to the narrowing of the contours of the tooth surface at or near the CEJ, where the crown meets the root. When referring to direction in relation to entities on or of the crown, it is nearly synonymous with both apical and gingival.

Coronal: The direction towards the crown of a tooth, as opposed to apical, which refers to the direction towards the tip(s) of the root(s) or apex(es). It may also refer to something relating to the crown, such as coronal forces.[1]

Distal: The direction towards the gingiva beyond the tooth furthest from the anterior midline (the 'most posterior tooth' or last tooth) in each quadrant of a dental arch, as opposed to mesial, which refers to the direction towards the anterior midline. Each tooth can be described as having a distal surface and, for posterior teeth, a distobuccal (DB) and a distolingual (DL) corner or cusp.

Facial: The side of a tooth that is adjacent to (or the direction towards) the inside of the lips, as opposed to lingual or palatal (both oral), which refer to the side of a tooth adjacent to (or the direction towards) the tongue or palate, respectively, the oral cavity. However, this term has been incorrectly used as an umbrella term for both the term buccal and labial, being also applied to the side of a tooth that is adjacent to (or the direction towards) the inside of the cheek (instead of the more accurate term, vestibular).

Gingival: The direction towards the gingiva (gums), synonymous with cervical and similar to apical. However, locations on teeth already more apical to the interface of the crown and root, referred to as the CEJ, tend not to be described using this term, as it would lead to confusion, as the exact definition is ambiguous. Additionally, this term would not be used when referring to a tooth ex vivo.

Incisal: The direction towards the biting edge of anterior teeth or something relating to this edge, such as the terms incisal guidance or incisal edge. This is the sister term to occlusal, which related to the analogous location on posterior teeth.

Inferior: The direction towards the feet of a human's body, as opposed to superior, which refers to the direction towards the head. However, use of these terms should enjoy only limited usage when discussing features of a tooth, as, for example, something more inferior on a mandibular tooth will be situated more superior on a maxillary tooth, as they exhibit an inverted relationship. It is for this reason that the terms coronal and apical are substituted.

Interproximal: An adjective meaning between teeth. For example, interproximal teeth refers to the space between adjacent teeth.

Labial: The side of a tooth that is adjacent to (or the direction towards) the inside of the lip (labium), as opposed to lingual or palatal (both oral), which refer to the side of a tooth adjacent to (or the direction towards) the tongue or palate, respectively, the oral cavity. Although technically referring only to anterior teeth (where the lips (labia) are present instead of cheeks), use of the term buccal has inaccurately extended to all teeth, anterior and posterior (instead of vestibular, the umbrella term).

Lingual: The side of a tooth adjacent to (or the direction towards) the tongue (*lingua*, compare linguistics and language), as opposed to buccal, labial, or vestibular which refer to the side of a tooth adjacent to (or the direction towards) the inside of the cheek or lips, respectively. Although this term is technically specific to the mandible, it enjoys extensive use in reference to the maxilla as well (see Palatal).

Mandibular: Entities related to the mandible, or lower jaw.

Marginal: A number of different 'margins' that are involved in dentistry. The edge of tooth structure that is prepared to meet the edge of a prosthetic crown is called a margin, as is the aforementioned edge of the crown; an example of this usage would be "a poorly fitting crown might exhibit marginal leakage." The gingiva and bone that abut the teeth are referred to as 'marginal', as in marginal periodontitis. The bulk of tooth structure on the occlusal surface at the point of contact of posterior teeth is referred to as the marginal ridge.

Maxillary: Entities related to the maxilla, or upper jaw.

Mesial: The direction towards the anterior midline in a dental arch, as opposed to distal, which refers to the direction towards the gingiva beyond the tooth furthest from the anterior midline (the 'most posterior tooth' or last tooth) in each quadrant. Each tooth can be described as having a mesial surface and, for posterior teeth, a mesiobuccal (MB) and a mesiolingual (ML) corner or cusp.

Midline: Dental midline. Roughly, an imaginary vertical line dividing the left and right sides of the mouth at the teeth.

Occlusal: The direction towards the biting surface of posterior teeth or something relating to this surface, such as the terms occlusal interference or occlusal surface. This is the sister term to incisal, which related to the analogous location on anterior teeth.

Oral: The side of a tooth adjacent to (or the direction towards) the oral cavity, as opposed to buccal, labial or vestibular, which refer to the side of a tooth adjacent to (or the direction towards) the inside of the cheek, lips or vestibule respectively. This term is an umbrella term for both the term palatal and lingual. Alternatively, the term lingual has been used as a blanket term instead although this specifically refers only to the side of a tooth that is adjacent to (or the direction towards) the tongue, technically specific to the mandible.

Palatal: The side of a tooth adjacent to (or the direction towards) the palate, as opposed to buccal, labial or vestibular which refer to the side of a tooth adjacent to (or the direction towards) the inside of the cheek, lips and vestibule of the mouth respectively. This term is strictly used in the maxilla.

Posterior: The direction towards the back of an individual's head, as opposed to anterior, which refers to the directions towards an individual's lips. The term posterior teeth refers to premolars and molars, as opposed to incisors and canines, which are anterior teeth.

Dental quadrants: The dentition is divided into four quarters. The two dental arches form an oval, which is divided into quadrants:

Upper right quadrant: upper right central incisor to upper right wisdom tooth ("or third molar")

Upper left quadrant: upper left central incisor to upper left wisdom tooth ("or third molar")

Lower right quadrant: lower right central incisor to lower right wisdom tooth ("or third molar")

Lower left quadrant: lower left central incisor to lower left wisdom tooth ("or third molar")

Proximal: The surfaces of teeth that normally lie adjacent to another tooth. It is an umbrella term that includes both mesial and distal, such as when referring to the proximal surfaces of teeth.

Superior: The direction towards the head of a human's body, as opposed to inferior, which refers to the direction towards the feet. However, use of these terms should enjoy only limited use when discussing features of a tooth, as, for example, something more superior on a mandibular tooth will be situated more inferior on a maxillary tooth, as they exhibit an inverted relationship. It is for this reason that the terms coronal and apical are substituted.

Vestibular: The side of a tooth that is adjacent to (or the direction towards) the inside of the cheeks and lips, as opposed to lingual or palatal (both oral), which refer to the side of a tooth adjacent to (or the direction towards) the tongue or palate, respectively, the oral cavity. This term is an umbrella term for both the term buccal and labial. Alternatively, the term facial has been used as the umbrella term instead although this specifically refers only to the side of a tooth that is adjacent to (or the direction towards) the inside of the lips, as opposed to lingual or palatal (both oral), and not the cheeks.

I. Types of Mouth Guards.

Figure 1B:
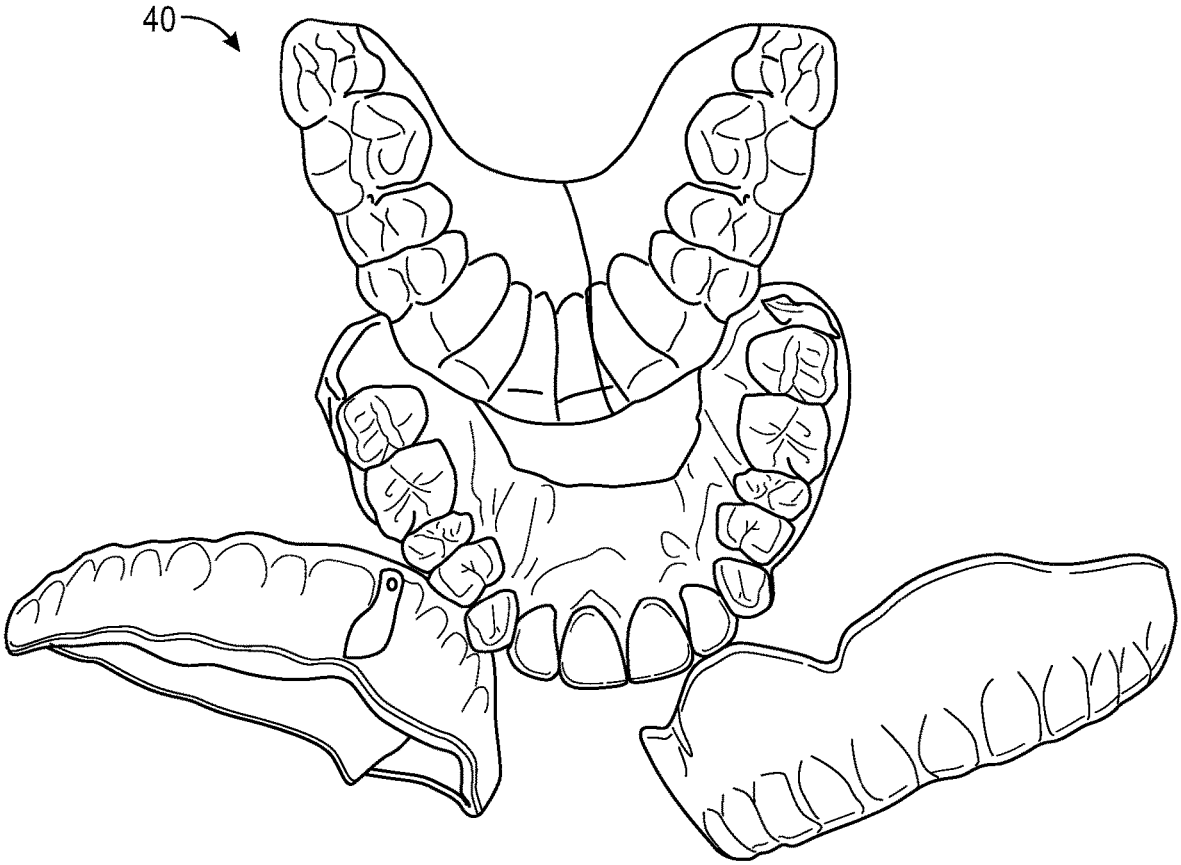
FIG. 1B is a schematic illustration of a mouth guard custom-made by a dentist using a pressure lamination method (40).
Figure 2A:
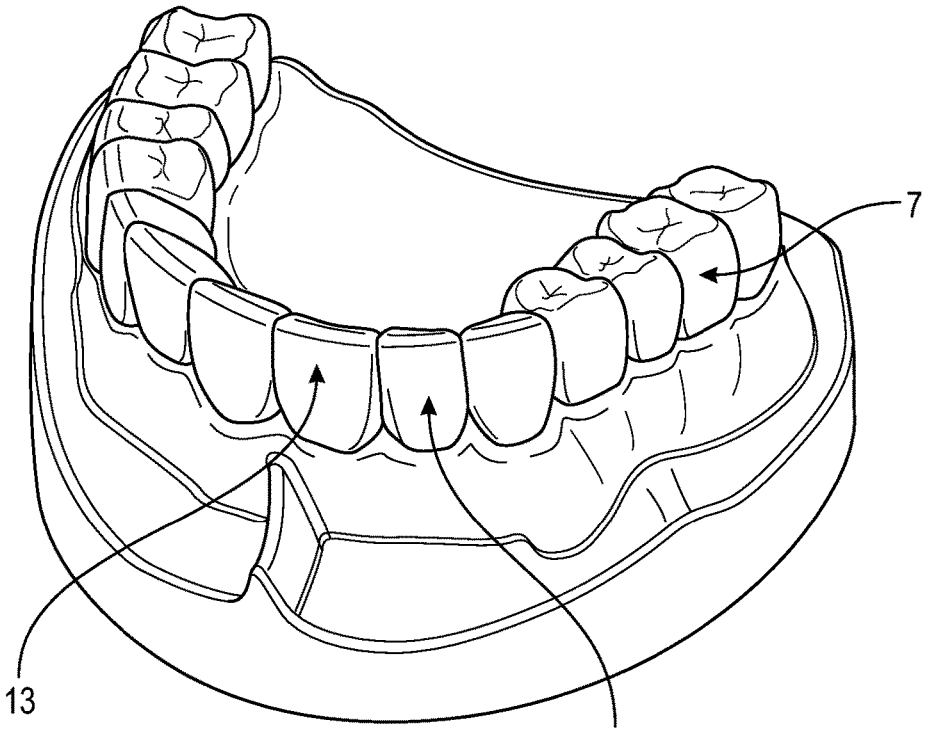
FIG. 2A is a schematic illustration of a model made from an impression of the top teeth, showing various portions, including posterior teeth (7), anterior teeth (11), and an edge portion (13) that is the biting surface between the upper and lower teeth.
Figure 2B:
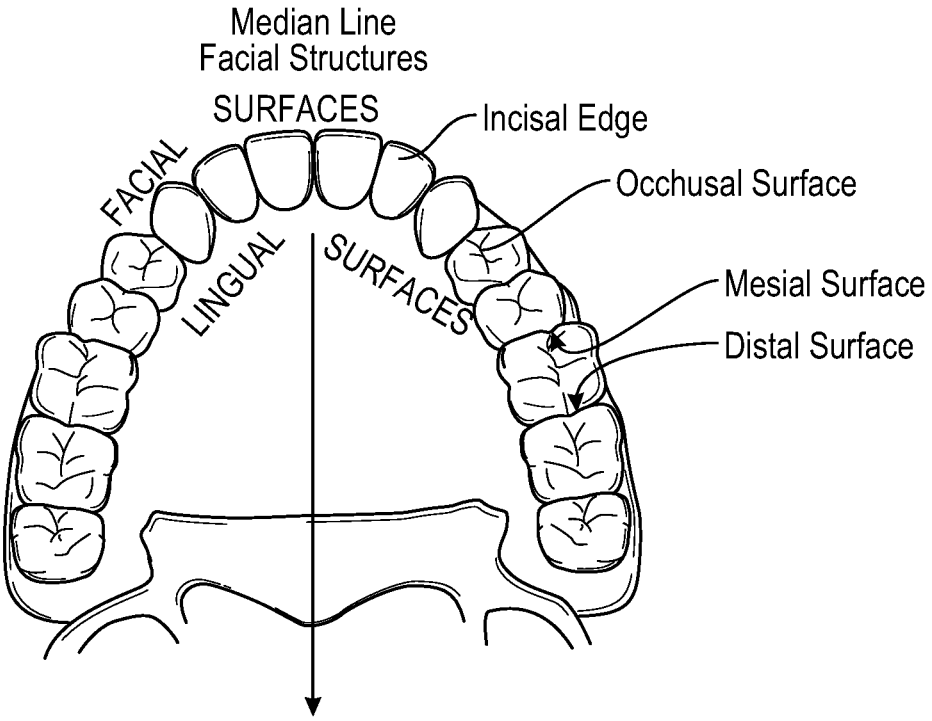
FIG. 2B is an illustration of the top teeth.

There are various types of mouth guards, which are shown in FIGS. 1A and 1B. FIG. 1A is a schematic illustration showing a stock mouth guard (10), a store-bought "boil-and-bite" mouth guard (20), and a mouth guard custom-made by a dentist using a heat and vacuum method (30). FIG. 1B is a schematic illustration of a mouth guard custom-made by a dentist using a heat and pressure lamination method (40).

In some embodiments of the mouth guards described herein, the mouth guards are boil-and-bite mouth guards. In other embodiments, the mouth guards are custom-made mouth guards, produced either using a vacuum approach or a pressure-laminate approach. While the boil-and-bite mouth guards tend to be significantly less expensive, and can be produced in a very short time frame, there are significant advantages to custom mouth guards. Compared with boil-and-bite mouth guards, they are more retentive, with a snug fit, the custom-made mouth guards have increased strength, are more comfortable, make it easier to speak, are more aesthetically pleasing, and increase the air exchange (i.e., oxygen/carbon dioxide exchange).

Most mouth guards have a thickness in the range of between about 1 and about 8 mm, more preferably between about 1 and about 5 mm, and most preferably between about 2 and about 4 mm.

II. Materials and Methods Used to Make the Mouth Guards

The types of materials used to prepare the mouth guards depend on the type of mouth guards.

The so-called "boil-and-bite" mouth guards are typically prepared using a thermoplastic material like ethylene-vinyl acetate copolymers (EVA), as well as polyolefinic rubber, silicone rubber, and an ethylene-vinyl acetate copolymer supplemented with a thermoplastic polycaprolactone as disclosed in Japanese Patent Gazette No. 2594830.

Custom mouth guards and some boil-and-bite mouth guards include elastomeric polymer layers as well.

Representative polymers that can be used to prepare the mouth guards described herein include those described in U.S. Pat. No. 7,182,086. The '086 patent teaches polymers, including block copolymers that include one or more polymer blocks made from vinyl aromatic compound, such as styrene, and hydrogenated products thereof, and one or more polyisoprene blocks. The polyisoprene blocks have a content of 1,2-bonds and 3,4-bonds of 40% by mol or more. Block copolymers also include those with one or more polymer blocks A made of a vinyl aromatic compound with a number average molecular weight between about 2,500 and 50,000, and one or more polymer blocks C which contain an isoprene unit and a butadiene unit in a ratio of from 5/95 to 95/5 (% by weight), more typically from 10/90 to 90/10 (% by weight) and have a content of 1,2-bonds and 3,4-bonds of 40% by mol or more.

Representative vinyl aromatic compounds include styrene, alpha-methylstyrene, 1-vinylnaphthalene, 3-methyl styrene, 4-propyl styrene, 4-cyclohexylstyrene, 4-dodecyl styrene, 2-ethyl-4-benzylstyrene, and 4-(phenylbutyl)styrene.

Copolymer blocks C have a number-average molecular weight ranging from around 10,000 to around 300,000, more typically, from 10,000 to 200,000. Block copolymers also include those with one or more polymer blocks A made of a vinyl aromatic compound, and one or more polybutadiene blocks D having a content of 1,2-bonds of 60 mole % or more, more typically, 80 mole % or more, and most preferably 85 mole % or more. The number-average molecular weight of polymer block D is within a range of around 10,000 to 300,000, more typically from 10,000 to 200,000.

In each of these copolymers, the content of the vinyl aromatic compound units is from 10 to 40% by weight.

Boil-and-Bite Mouth Guards

Boil-and-bit mouth guards generally fall into two different categories, namely, ones that include a single type of polymer, namely, a thermoplastic polymer, and composite mouth guards that typically include one or more rubber layers, and a thermoplastic layer.

In either case, the mouth guard is placed into boiling water to soften the thermoplastic polymer, the mouth guard is placed in the user's mouth, the user bites into the mouth guard, and the mouth guard is then removed from the user's mouth and, typically, cooled so as to set the thermoplastic polymer.

Mouth guards formed of a single layer of thermoplastic polymer are typically formed from EVA (ethylene vinyl acetate), though other thermoplastic polymers can be used.

Where a composite mouth guard is used, they can include a first layer formed of any suitable material that provides a desired level of impact resistance. Examples include elastomeric (i.e., "rubbery") materials, such as block copolymers including isoprene, styrene, acrylonitrile, and/or butadiene blocks, and blends of EVA (ethylene vinyl acetate) and TPU (thermoplastic polyurethane), such as those available commercially under the CORESHOCK® tradename. In some embodiments, the elastomeric material is a thermoplastic rubber available commercially under the KRATON® tradename, from GLS Plastics of 740B Industrial Drive, Cary, Ill. 60013. This thermoplastic rubber is unique in that it is injection-moldable, FDA approved and readily adheres with copolymers of ethylene and vinyl acetate.

The mouth guard can include a second layer of a thermoplastic polymer such as EVA (ethylene vinyl acetate), which overlies the first layer, and comes into contact with the user's teeth. The first and second layers can be adhered using any suitable non-toxic adhesive.

In some embodiments, the second layer forms a substantial portion of the inner lingual wall. The second layer may be formed of any suitable material, such as can be formed of EVA, which in some cases is clear and translucent or transparent.

There are at least two ways to form these mouth guards. The first is to form a U-shaped mouth guard with an even thickness throughout the entire lingual wall, and have the user fit the mouth guard by boiling water, heating the thermoplastic polymer in the water, fitting the mouth guard, and then cooling the thermoplastic polymer. Then, a portion of anterior lingual wall of the mouth guard that covers portions of the lingual/palatal surfaces that interfere with speech can be removed, such as by trimming with a knife or grinding off those portions of the mouth guard.

The second way is to form a U-shaped boil-and-bite mouth guard, either as a single layer of thermoplastic material or as a composite material, that has an even thickness throughout the two posterior lingual walls, but which tapers to around 1 mm to ⅓ of the height of the rest of the lingual wall in the anterior portion of the mouth guard. The user can then fit the mouth guard by boiling water, heating the thermoplastic polymer in the water, fitting the mouth guard, and then cooling the thermoplastic polymer. If, during the fitting, a portion of the thermoplastic material extends upward into the anterior lingual wall in a way that interferes with speech, that portion can be trimmed, ground off, or otherwise removed.

Custom-Made Mouth Guards

Conventional custom mouth guards are manufactured using a dental impression or replica of an individual's teeth, in particular the individual's upper teeth. The individual is provided with a tray filled with a modeling compound, which forms a negative impression when bitten. The negative impression may then be used to form a positive mold of the individual's teeth. Custom mouth guards can be created from the negative impression by vacuum forming or heat laminating generally thin polymer layers around the positive mold.

Another method which can be used involves taking a digital scan of the upper (maxillary) arch. From this scan, and by using specialized computer software, a positive mold of the individual's teeth can be replicated.

Custom mouth guards can be created from the negative impression (or digital scan) by vacuum forming or heat laminating generally thin polymer layers around the positive mold.

By way of illustration, a custom mouth guard for an individual can be formed by obtaining a positive mold of the individual's upper teeth and gums, molding a first layer that includes an ethylene vinyl acetate/thermoplastic polyurethane copolymer onto the positive mold, disposing an impact shield and framework on the first layer, if desired, and molding a second layer including ethylene vinyl acetate onto the positive mold, thereby encapsulating a portion of the impact shield and framework, if such is present.

By way of further illustration, a custom mouth guard having a tray floor, an outer labial wall and an inner lingual wall can be formed by disposing a first layer having an ethylene vinyl acetate/thermoplastic copolymer, a second layer including an ethylene vinyl acetate polymer, and a rubber impact shield, if desired, disposed between the first layer and the second layer, onto the mold. The first layer may form a substantial portion of the tray floor and the outer labial wall while the second layer may form a substantial portion of the inner lingual wall.

Typically, before the second layer is applied to the first layer, the first layer is evenly heated and vacuum formed, or heat laminated, around the positive mold. So as to avoid contacting more of the lingual surface than is desired, the first layer can be trimmed before the second layer is applied. An optional layer of adhesive can be applied between individual layers.

As disclosed in U.S. Pat. No. 8,607,798, owned by "Shock Doctor," a custom mouth guard may be formed from a multiple layer assembly including an ethylene vinyl acetate/thermoplastic polyurethane layer, an ethylene vinyl acetate layer and an intervening impact shield and elastomeric framework, which elastomeric framework can include one or more posterior occlusal pads. The custom mouth guard can be molded to a positive mold of an individual's upper teeth and gums. The impact shield and elastomeric framework are described elsewhere herein.

If desired, a pre-formed, molded impact brace can be positioned adjacent to the first layer, on the optional adhesive, and a second layer can be evenly heated and placed over the first layer and optional impact shield. The application of a vacuum or heat lamination adheres the first layer to the second layer, and causes at least portions of the impact shield, if such is present, to be encapsulated within the first and second layers. Any excess layer material from the second layer, such as any portion that would cover undesired portions of the front lingual surface, can then be trimmed from the mouth guard. If the customer desires to have a retention strap attached to the mouth guard, a hole may be formed in the first and second layer at the point where the retention strap is optionally attached. Although this process is described sequentially, in one embodiment the first layer, optional impact shield, and second layer are vacuum formed substantially simultaneously.

Each of the layers can be formed of distinct materials that provide the resulting mouth guard with desired properties and performance. In some embodiments, the first layer can form a substantial portion of the tray floor, as well as an inner surface of the outer labial wall. As such, the first layer may provide a substantial amount of impact protection to the wearer's teeth. The first layer can be formed of any suitable material that provides a desired level of impact resistance. Illustrative but non-limiting examples of suitable materials include blends of EVA (ethylene vinyl acetate) and TPU (thermoplastic polyurethane), and in some embodiments, the first layer is formed from an EVA/TPU available commercially under the CORESHOCK® tradename.

In one embodiment, the impact shield is a molded part formed from a polymer that provides a desired blend of strength and impact energy dissipation. In some embodiments, the shield is formed of a composite of a copolymer of ethylene and vinyl acetate and an elastomeric material such as thermoplastic rubber or vulcanized rubber. An example of a suitable copolymer of ethylene and vinyl acetate is ELVAX® resin marketed by the OP Division of Ashland Chemical Co, such as ELVAX® 350 through ELVAX® 450. In one embodiment, ELVAX® 450 is used, which has 18% by weight vinyl acetate. In some embodiments, the impact shield includes 50% to 80% by weight of the elastomeric material and 20% to 50% by weight of the copolymer of ethylene and vinyl acetate.

In some embodiments, the elastomeric material is a thermoplastic rubber available commercially under the KRATON® tradename, from GLS Plastics of 740B Industrial Drive, Cary, Ill. 60013. This thermoplastic rubber is unique in that it is injection moldable, FDA approved and readily adheres with copolymers of ethylene and vinyl acetate.

In some embodiments, the second layer forms a substantial portion of the inner lingual wall. The second layer may be formed of any suitable material. In some cases, the second layer is formed of a clear material. The second layer can be formed of a copolymer of ethylene and vinyl acetate, such as EVA. In one embodiment, the second layer is formed from a material that softens when contacted with boiling water, such that a user can further augment the dental impression formed in the mouth guard tray.

In one embodiment, a mouth guard is custom fit to an individual user without using a boiling process. As disclosed in U.S. Pat. No. 8,235,052, the mouth guard can be a cold formable mouth guard that allows the user to fit the mouth guard by depressing cilia that extend upwardly in the canal where the teeth are to be placed. This arrangement allows for a snug fit every time without the hassles of boiling and compression fitting the boiled mouthpiece. In other words, the cilia allow the mouth guard to conform to the shape of a mouth and provide excellent energy absorption and dissipation when subjected to force such as that experienced during athletic activity, without the requirement for molding an inner liner or requiring a "boil-and-bite" procedure.

In the "cilia-containing" mouth guard, the mouth guard comprises a first U-shaped structure with an inner wall and outer wall connected to each other by a base, which forms a channel between the inner and outer walls, and is designed for the user's upper teeth, and a second U-shaped structure with an inner wall and outer wall connected to each other by a base, forming a channel between the inner and outer walls, and designed for the lower teeth of a user. The first and second U-shaped structures are attached to each other by the underside of each of the bases, so the user can remove the mouth guard as a single unit.

A plurality of flexible extensions, referred to as "cilia" are dispersed in and project away from the base within the channel, toward the user's teeth. The cilia are constructed of an elastomeric material that is formable to the dentition of a wearer at room temperature. That is, when the mouth guard is placed into the mouth of the user, the cilia are either depressed, or moved to the side of the teeth, so as to allow the mouth guard to fit tightly into the user's mouth.

III. Composite Mouth Guards

A composite mouth guard is one which includes two or more layers of different materials. The use of different materials allows one to provide different properties. For example, by using a thermoplastic layer, one can achieve a custom fit by softening the thermoplastic polymer, and allowing the user to bite into the softened material. However, the thermoplastic material, such as EVA, is not necessarily ideal for absorption, attenuation and dissipation of shock forces exerted on the mouth guard during athletic activity. Furthermore, the thermoplastic material can be deformed, and break down, with continued use and chewing thereon by the wearer. Accordingly, a composite mouth guard can also include a layer of a more elastomeric, or "rubbery," polymers, such as the styrene/butadiene/nitrile/isoprene block copolymers described above.

Both boil-and-bite and custom-made mouth guards can be made of composite materials. In one embodiment, at least one composite layer is positioned such that when the user bites down, the top teeth come into contact with a thermoplastic layer, and, underlying the thermoplastic layer is a layer of an elastomeric polymer. In one aspect of this embodiment, a further thermoplastic layer underlies the elastomeric layer, such that the lower teeth of the user contact this further thermoplastic layer.

In custom mouth guards, there is no need for a thermoplastic layer, so long as the mouth guard is designed so as to fit the upper and lower teeth of the user. However, in one embodiment, custom mouth guards include one or more thermoplastic layers.

IV. Mouth Guards with Shock-Absorbing Layers and/or Wedges to Increase Power and Performance In some embodiments, the mouth guards described herein include one or more of shock-absorbing layers and/or "power" wedges. The shock absorbing layers can provide more impact protection than the thermoplastic and/or rubber layers alone. The power wedges can provide optimal positioning of the lower jaw, so as to provide more power than where the upper and lower jaw are in their ordinary alignment (i.e., how they are aligned during a normal bite).

U.S. Pat. No. 5,339,832 to Kittelsen discloses a composite mouth guard that also includes a shock-absorbing layer. As disclosed in the '832 patent, the mouth guard has a flexible and tough, softenable thermoplastic mouth guard portion with a U-shaped base having upward inner lingual and outer labial walls extending therefrom. A shock absorbing and attenuating non-softening, resilient, low compression, elastomer framework can be embedded in the mouth guard portion to absorb, attenuate and dissipate shock forces exerted on the mouth guard during athletic activity.

The mouth guard includes a thermoplastic portion, which is generally horse shoe or U-shaped, with an embedded or substantially internal elastomeric framework forming posterior cushion pads and an anterior impact brace. In one embodiment, the elastomeric framework is initially molded or formed, and then the thermoplastic mouth guard portion is injection molded around the elastomeric framework.

The U-shaped base has a top side and a bottom side. Extending upwardly are inner lingual and outer labial walls forming a channel therebetween for receiving the upper jaw and teeth. The thermoplastic mouth guard portion has a posterior portion and an anterior portion.

In one embodiment, thermoplastic occlusal posterior pads can be located along the bottom side of the posterior portion of the U-shaped base. These thermoplastic occlusal posterior pads space apart the anterior teeth of the lower jaw from the anterior portion of the bottom side of the U-shaped base. In this embodiment, where the mouth guard is designed to not only avoid placing material on the bulk of the palatal/lingual surface, but also provide additional spacing between the lower anterior teeth and the upper anterior teeth, the mouth guard can significantly facilitate breathing and speech, lessens condyle pressure and impact upon the cartilage, the temporomandibular joints, the arteries and the nerves.

Optionally, the mouth guard can include occlusal posterior pads, which permit the lower jaw to be positioned forwardly and anteriorly in a range of 1 to 4 millimeters depending upon the desired position, to assume a power position allowing the most freedom and least amount of potential impingement to the TMJ and surrounding tissues.

The elastomeric framework is preferably made of an elastomer, which, unlike copolymers of ethylene and vinyl acetate, exhibits a high resilience, low compression, shape maintenance and shock absorption, attenuation and dissipation. Virtually all rubbers that exhibit these physical characteristics can be used for the elastomeric framework, including vulcanized rubber, block copolymers including styrene/butadiene/nitrile/isoprene units, and the thermoplastic rubber marketed under the trademark KRATON® (GLS Plastics of 740B Industrial Drive, Cary, Ill. 60013). Some advantages to using the KRATON® rubber are that it is injection moldable, FDA approved, readily adheres with EVA, and has a melting or softening point significantly higher than that of EVA.

In another embodiment, the elastomeric framework has posterior cushion pads which suitably lay within the posterior portions of the U-shaped base, or can be embedded within the occlusal posterior pads or between the pads and the U-shaped anterior base portions. The posterior cushion pads typically have enlarged portions suitably in the bicuspid and molar regions of the teeth, which enlarged portions can take the form of spheres, columns, or knobs. The enlarged molar portions or spheres are suitably positioned to fit in the area of the first adult molars. The bicuspid enlarged portions appropriately fit on the bicuspid teeth adjacent the canine or eyeteeth.

In use, the posterior cushion pads, together with the enlarged portions, cause the mandible or lower jaw to slide forwardly and slightly downwardly. Also, the condyles are moved downwardly and away from the fossae or sockets without the need for exotic devices and/or measurements, articulation, etc. Furthermore, the posterior cushion pads with the enlarged portions assure proper fitting of the composite mouth guard when softened by prohibiting the user from biting too deeply into the soft EVA material of the thermoplastic mouth guard portion. Further, the bicuspid enlarged portions assure that there is no excessive upward displacement of the anterior portions of the lower movable jaw or mandible.

In one aspect of this embodiment, a raised ridge on the top and bottom of the posterior cushion pad connects the enlarged portions. This ridge can force the softened thermoplastic (such as EVA) material of the thermoplastic mouth guard portion to remain in the occlusal biting surfaces or grooves while fitting.

Moving forwardly, a transition support portion can extend forwardly from the posterior cushion pads and connect to an anterior impact brace. The anterior impact brace has protruding anterior cushion pads which extend through the upward outer labial wall to actually contact the anterior teeth of the upper jaw to advantageously absorb, attenuate and dissipate shock exerted at this position of the mouth guard. The anterior cushion pads extend rearwardly through the anterior portion of the outer labial wall.

To fit this type of mouth guard, the mouth guard can be momentarily submersed into boiling water to melt the thermoplastic material. The mouth guard is then immediately placed onto the teeth of the upper jaw, and the lower jaw is positioned forwardly or anteriorly in a range of 1 to 4 millimeters as the posterior teeth engage the enlarged portions (with or without occlusal posterior pads). The wearer then applies suction between the upper jaw and the mouth guard, optionally while packing the mouth guard with his/her hands along the cheeks and lips adjacent the anterior and posterior teeth of the upper jaw. The posterior teeth of the lower jaw will properly index upon the bottom surface of the occlusal posterior pads or the posterior portion of the U-shaped base.

In these embodiments, the user of the composite mouth guard will not only have the benefits of being able to speak, breathe, and rehydrate easily by virtue of having the right portions of the palatal/lingual surfaces uncovered, but also will have correct jaw posture for athletic participation, which will assure minimal impact injury to the TMJ as well as the surrounding tissues, teeth and respective jaws.

The elastomeric framework with its component parts can absorb, attenuate and dissipate shock forces, and due to the power positioning and posture of the TMJ joints, the user can experience increased endurance, performance and muscular freedom.

V. Mouth Guards with a Front Shield

It can be advantageous for the mouth guards to include a front impact shield, typically formed of a relatively hard plastic.

In one embodiment, the impact shield is a molded part formed from a polymer that provides a desired blend of strength and impact energy dissipation. In some embodiments, the shield is formed of a composite of a copolymer of ethylene and vinyl acetate and an elastomeric material such as thermoplastic rubber or vulcanized rubber. An example of a suitable copolymer of ethylene and vinyl acetate is ELVAX® resin marketed by the OP Division of Ashland Chemical Co, such as ELVAX® 350 through ELVAX® 450. In one embodiment, ELVAX® 450 is used, which has 18% by weight vinyl acetate. In some embodiments, the impact shield includes 50% to 80% by weight of the elastomeric material and 20% to 50% by weight of the copolymer of ethylene and vinyl acetate.

For boil-and-bite mouth guards that consist of a single thermoplastic layer, a front shield can be embedded in the thermoplastic layer. For boil-and-bite mouth guards that are composite mouth guards, with a thermoplastic layer and a second layer, such as a rubber layer, a front impact shield can be embedded in the thermoplastic layer, in the second layer, or between the layers.

In either of these types of mouth guards, an impact shield can alternatively include a mechanical means for attachment, such as one or more pins that fit into one or more holes in the mouth guard. Particularly where a rubber is used, if the pins are sized slightly wider than the holes, the shield can be forced into the holes by expansion of the rubber, and this creates a relatively tight fit. Ideally, where a front shield is to be mounted on the outside surface of the mouth guard, the mouth guard is designed to include a recess sized to precisely fit the shield, so that the shield fits flush in the front of the mouth guard.

One example of this latter embodiment is seen in mouth guards by Under Armour®, where a clip attached to a relatively long plastic piece clips into the front of the mouth guard to make it easier to place the mouth guard into, and remove it from, boiling water. After the mouth guard is fit into place, the clip can be removed, and an impact shield can be inserted.

Custom mouth guards can also include an impact shield. Typically, this shield would be incorporated into the mouth guard during the fabrication process rather than mechanically attaching it afterward.

A custom mouth guard is typically formed by being molded, using heat and/or pressure, to a positive mold of an individual's upper teeth and gums. A custom mouth guard can include a multiple layer assembly including a first thermoplastic layer, a second thermoplastic layer and an intervening and/or embedded impact shield and/or elastomeric framework. As discussed elsewhere herein, the elastomeric framework can include one or more posterior occlusal pads partially or completely embedded in or disposed between these layers.

Custom mouth guards with two or more layers and an impact shield can be formed by vacuum forming a first polymer layer onto a positive mold of a dental impression, positioning a molded impact shield adjacent the first layer, and vacuum forming a second layer onto the positive mold, thereby encapsulating at least a portion of the impact shield between the first and second layers. The impact shield may include an anterior portion having an opening. After forming the custom mouth guard, the first and/or second layers can be pierced to form a through-hole for attaching a strap, if desired.

VI. Mouth Guards with Flavor-Enhancement and/or Antimicrobial Enhancement

In some embodiments, the mouth guards are prepared with a polymer that includes antimicrobials, and/or includes a flavor enhancement. Flavoring components, and mouth guards including flavoring components, are described, for example, in U.S. Pat. No. 8,235,052 by Maurello.

For example, silver particles, chitosan, or antimicrobial particles can be present in one or more of the polymers used to prepare the mouth guard.

In one embodiment, the mouth guard comprises a flavoring component. The flavoring agent may contain a sweet flavor, mint flavor, vanilla flavor, bubblegum flavor, sour flavor, cola flavor or in the alternative an electrolyte or caffeine based solution that can be released during a sports competition when the player has lost electrolytes because of perspiration or if the player is feeling fatigued.

The flavoring component can be impregnated directly within the material from which the mouth guard is constructed, for example, in the form of an evenly dispersed emulsion, or as flavor crystals that are dispersed throughout the mouth guard. These flavor crystals release flavor into the mouth of the user as they dissolve. The flavor agent whether as an emulsion or in the form of crystals can also provide a fragrance to the mouth guard. The flavoring agent can mask the often stale smell and taste of a mouth guard that has been used and stored several times.

In an alternative embodiment, the mouth guard can include at least one pocket formed in the inner walls, outer walls or base of the mouth guard. The pocket is sized and shaped to receive a flavoring agent capsule. The flavoring agent capsule can be constructed so as to release the flavoring agent once pressure is applied to it. The pocket is connected to at least one duct that extends from the pocket of the mouth guard to an inner surface of the mouth guard. This duct defines a passageway for the flavoring agent to flow from the pocket containing the flavoring agent to the mouth of the user when sufficient force is placed on the flavoring agent capsule by the user.

VII. Mouth Guards with an Anterior Ramp Design and, Optionally, Scalloped Anterior and/or Posterior Palatal Surfaces As used herein, "anterior teeth" include teeth numbers 6-11, which include the upper (maxillary) central incisors, lateral incisors and canines. "Posterior teeth" include teeth numbers 1-5 and 12-16, which include the upper (maxillary) premolars and molars.

The shape and design of the mouth guard, covering the lingual surfaces of the anterior teeth, which in one embodiment is beyond 3-4 mm of the incisal edges and cusp tips or the remaining gingival two-thirds, and in another embodiment is beyond the 40-50% from the incisal edges/cusp tip toward the gingiva, can be in linear in nature, curved (concave) in nature, or any other suitable design. This unique feature of this mouth guard allows the athlete the ability to speak, breathe and drink with comfort.

The thickest portion of the mouth guard covers the majority of the facial aspect and the incisal edges and cusp tips of the anterior teeth and additionally, in one embodiment, from around 3-4 mm up to the incisal/cuspal one-third of the lingual surface of the anterior teeth, and in another embodiment, from around 40 to around 50% of the lingual/palatal surface of the anterior teeth, from the incisal edge/cusp tip toward the gingiva. The thinnest portion of the portion of the mouth guard, which comes into contact with the lingual surface of the anterior teeth below the cingulum (or at the gingival margin) is, ideally, no less than around 25% to no more than around 35% of the thickness of the thickest portion of the mouth guard. In one embodiment, the thickness of the remaining portion of the mouth guard covering the area in between these two before mentioned sections of lingual surfaces of the anterior teeth, ranges from initially approximately 50% to a value of between around 35% and 25% of the thickest portion of the mouth guard. The buccal, occlusal, and lingual/palatal surfaces of the premolars and molars are covered by mouth guard material similar in thickness to the thickest portion of the mouth guard. As used herein, "similar in thickness" or "substantially similar in thickness" means "plus or minus 25% of the thickness."

In one embodiment, the mouth guard described herein is designed to be worn on the upper teeth, and, when the teeth are clenched, the bottom teeth fit inside a matching profile on the bottom side of the mouth guard. In another embodiment, the mouth guard is designed to be worn on the lower teeth, and, when the teeth are clenched, the top teeth fit inside a matching profile on the top of the mouth guard.

In one embodiment, the mouth guard is a boil-in-bite mouth guard. The material used in these mouth guards is thermoplastic, and the fit is obtained by allowing the material to flow while the wearer clenches down. As the mouth guard is fit, unless certain steps are taken ahead of time, the melted material might flow and create a fairly even thickness along the lingual surface of the anterior teeth. In one aspect of this embodiment, the mouth guard, before being fitted, exaggerates the transition in thickness, to account for some transfer of material while it is in the molten state. In another aspect of this embodiment, the material on the lingual surface of the anterior teeth is fairly even in thickness, but along the surface, is fitted with a quick-release sheet that lies between a portion of the material on this surface. After the mouth guard is fitted, and the quick-release sheet is pulled to release a portion of the material, the lingual surface will have the appropriate shape, whether linearly decreasing in thickness, decreasing in thickness along a concave curve, or some other shape profile, based on the shape of the portion of the material that is released and the portion of the material that is not released. In yet another aspect of this embodiment, if the lingual surface of the anterior teeth in the mouth guard as initially fitted includes a substantially even thickness, the surface can be shaped by holding the mouth guard and removing material on this surface by cutting, sanding, and the like. A curved or angled router blade, or similar bit attached to a Dremel® tool, can be sufficient to create this profile. To ensure a relatively even thickness, one can draw an appropriate curve along the anterior lingual surface, on the portion of the surface closest to the gumline, and trace this line with the Dremel® tool.

In another embodiment, the mouth guard is a custom-made mouth guard. The mouth guard is prepared by first taking an impression of the patient's teeth, and then prepared in a laboratory. Since the mouth guard is prepared outside of the patient's mouth, there is less of a concern about being able to create a difference in thickness. A desired profile can easily be prepared by a skilled dental laboratory, once they are instructed to include one. As with the boil-and-bite mouth guard, this can be accomplished by grinding away a certain amount of the thermoset material to create the profile, and, ideally, smoothing the ground surface to minimize irritation or discomfort caused by running the tongue against a less than smooth thermoset or thermoplastic surface.

Additional process steps can include thinning the buccal and facial borders, and extending them beyond the height of contour of the attached gingiva, and, optionally, making one or more "frenum reliefs." Further, in one aspect of this embodiment, the distal extensions cover the entire last maxillary molars (bilaterally) and seat firmly on the gingival tissue distal to the last upper molar. This can help seat the mouth guard in such a way that it is more difficult to dislodge by accident.

In various embodiments, the occlusal surfaces of the maxillary premolars and molars are covered in their entirety, the palatal surfaces of the maxillary premolars and molars are covered in their entirety, the incisal edges of the maxillary central and lateral incisors are covered in their entirety, the cusp tips of the maxillary canines are covered in their entirety, the gingival-palatal margins are "scalloped" to the gingival architecture, and combinations thereof, all while substantially maintaining the thickness of the mouth guard material.

In one embodiment, the mouth guard covers the palatal surface of the maxillary central and lateral incisors and the maxillary canines with a "ramp design". The "ramp design" is fabricated with the following specifications. In one aspect, 3-4 mm to at most one-third (the incisal one-third) of the lingual/palatal surface of the maxillary central and lateral incisors and the maxillary canines is covered, while substantially maintaining the thickness of the mouth guard material. In another aspect, between around 40 and around 50% of the lingual/palatal surface of the maxillary central and lateral incisors and the maxillary canines is covered, while substantially maintaining the thickness of the mouth guard material.

The remaining palatal surface (approximately, the gingival two-thirds) of the lingual/palatal surface of the maxillary central and lateral incisors and the maxillary canines is either concave or sloped (slanted), "thinning" to the gingival margin, and the gingival-palatal margins "scalloped" to the gingival architecture.

In one embodiment, the custom-made mouth guards are constructed using a resilient conformable thermoplastic material such as that manufactured under the trademark ELVAX™ or any other similar equivalent. A mold is made of the wearer's upper teeth so that the mouthpiece described herein can be formed and molded according thereto and according to the details of construction enumerated above. After the mouth guard is formed according to a mold of the upper teeth, indentions can then formed on the inner surface of the front wall and on the upper surfaces of the bottom wall that subsequently accommodate the wearer's teeth.

In any of these embodiments, or aspects of these embodiments, the mouth guard can further include one or more "frenum reliefs." The labial frenum often attaches to the center of the upper lip and between the upper two front teeth. To avoid pain or irritation if the mouth guard hits the frenum, a slight gap can be created such that the mouth guard does not hit the frenum. Similarly, there are buccal frenum attachments in the right and left maxillary posterior muccobuccal fold areas. To avoid pain or irritation if the mouth guard impinges on these the posterior buccal frenum attachments, a slight gap can also be created such that the mouth guard does not hit the frenum.

VIII. Benefits of Wearing Mouth Guards

It has been stated that the best mouth guard is the one that is actually worn. Ill-fitting and uncomfortable mouth guards can cause injuries, because the wearer removes the mouth guard due to the bad fit or lack of comfort, and as a result, suffers an injury. As discussed below, there are several benefits, including health benefits, associated with wearing a mouth guard. The fact that the mouth guards described herein are relatively comfortable, and allow the wearer to speak easily ("comfortably"), breathe easily ("comfortably"), and drink fluids easily ("comfortably"), means that they are more likely to be worn. Athletes are constantly seeking out a mouth guard that is "comfortable" to wear, "retentive" (stays in their mouth) and will also allow them "to speak" with it in place. Athletes, like football players, are also looking for a mouth guard that is both comfortable enough and retentive enough that they can keep it in their mouth for extended periods of time, without having to constantly remove it from their mouth due to lack of comfort.

It is a major advantage of the mouth guards described herein that athletes, such as football players, typically do not feel like they need to take a mouth guard in and out of their mouths between plays.

In certain sports, players do not have the opportunity to remove mouth guards in-between plays, for instance, basketball players, soccer players, girls' high school softball players, baseball and Little League players, extreme sports athletes, skate boarders, downhill skiers and ski jumpers, snow boarders, and downhill bicycle riders as well as lacrosse players and field hockey players.

In basketball, soccer, baseball (including Little League) and extreme sports athletes, skate boarders, downhill skiers and ski jumpers, snow boarders, and downhill bicycle riders, mouth guard usage is not required by any organizational body. Accordingly, since no mouth guard is required, it is important to have a comfortable mouth guard, as there tends to be less compliance than in those sports where a mouth guard is required.

The mouth guards described herein are comfortable enough to wear, and, as described elsewhere herein, have been evaluated in confidential clinical studies. These studies are unprecedented in their nature and in their results. The studies included both a quality assessment study and a compliance of usage study, which was conducted among NCAA College Men's Basketball Players, extreme winter sports athletes.

Mouth guard usage is required in football, lacrosse and field hockey, so it is particularly advantageous for these sports that the mouth guards described herein are comfortable. The comfort has, in fact, been supported by clinical studies described elsewhere herein, which studies are, again, unprecedented. This research include both a quality assessment study and a compliance of usage study which was conducted among NCAA College Women's Field Hockey and Lacrosse Players as well as with a high school softball player and football player.

Some researchers indicate that wearing a custom-made mouth guard can mitigate the occurrence of head injuries. ("Effect of Clenching with a Mouth guard on Head Acceleration during Heading of a Soccer Ball". Narimatsu, N., Takeda, T., Nakijima, K., Kommo, M., Ozawa, T., Ishigami, K. General Dentistry—Special Sports Dentistry Section, Pages 41-45, November/December 2015.) Additionally, mandibular repositioning and subsequent neuromuscular activity are proposed mechanisms of action for commercial mouth guards marketed for performance enhancement. Other researchers have discovered that participants preferred custom-made nearly 2:1 over self-fit performance mouth guards (P=0.05). Participants perceived that they were stronger and less encumbered when using a custom-made mouth guard during sub-maximum power clean lifts. (Effects of Mouth guards on Vertical Dimension, Muscle Activation, and Athlete Preference: A Prospective Cross-Sectional Study". Gage, C., Huxel Bliven, K., Bay, R., Sturgil, J. and Park, J. General Dentistry—Special Sports Dentistry Section, Pages 48-55, November/December 2015.) These recent research findings have been associated with wearing a custom-made mouth guard. This new prototype mouth guard is custom-made in nature and by design. Therefore, based on the results of these research projects, one can reasonably extrapolate that if an athlete wears this new prototype mouth guard, he/she can experience these same advantages.

Example 1

Fabrication of a Custom-Made Mouth Guard

In this example, the mouth guard includes a pair of posterior portions for encompassing the posterior teeth (premolars and molars) that are interconnected with a front segment. The posterior portions are interconnected with a front portion that overlays the anterior teeth (incisors and canines). This anterior segment contains an "Innovative Ramp Design."

It is dimensioned to cover substantially the incisal edges of the maxillary incisors, cusp tips of the maxillary canines as well as all of both the front and back surfaces of the maxillary anterior teeth.

The "Innovative Ramp Design" is fabricated with the following specifications: (a) in one aspect, 3-4 mm to at most one-third (the incisal one-third) of the lingual/palatal surface of the maxillary central and lateral incisors and the maxillary canines should be covered and maintain the thickness of the mouth guard material, and in another aspect, between about 40 and about 50% of the lingual/palatal surface from the incisal edge/cusp tip toward the gingiva of the maxillary central and lateral incisors and the maxillary canines should be covered and maintain the thickness of the mouth guard material, and (b) the remaining palatal surface (in one aspect, approximately, the gingival two-thirds, and in another aspect, the remaining around 50 to around 60%) of the lingual/palatal surface of the maxillary central and lateral incisors and the maxillary canines should be concave or sloped (slanted), "thinning" to the gingival margin, and the gingival-palatal margins "scalloped" to the gingival architecture. The posterior portions each include an inner and outer wall.

The outer wall is thinned and terminates in the anterior and posterior mucco-buccal fold for added retention with the inner wall terminating with a "scalloped" design at the gum line. These considerations help to minimize discomfort to the wearer. It is therefore an object of the present invention to provide a mouth guard that is comfortable to wear. This mouth guard is specially designed so that it will allow an athlete to speak, breathe and drink with comfort. This mouth guard can be placed in one's mouth and left in it for long and extended periods of time, without the need for constant removal.

In this example, the mouth guard is prepared according to the following specifications.

Figure 3:
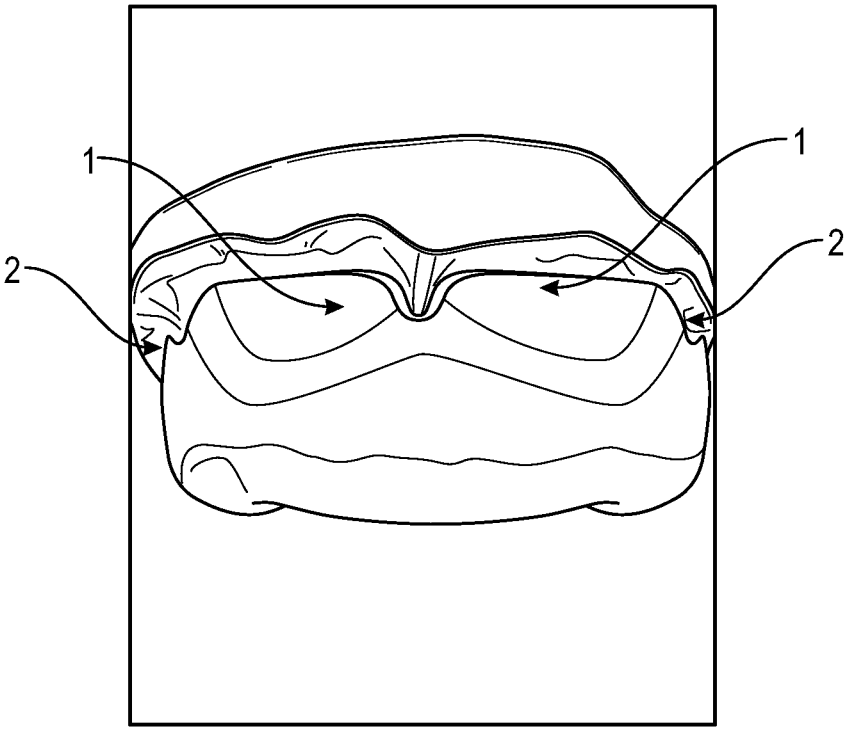
FIG. 3 is a schematic illustration showing the front view of one embodiment of the mouth guard described herein, resting on a model of a wearer's upper dentition. The schematic illustration shows the facial border (1) and the buccal border (2).
Figure 4:
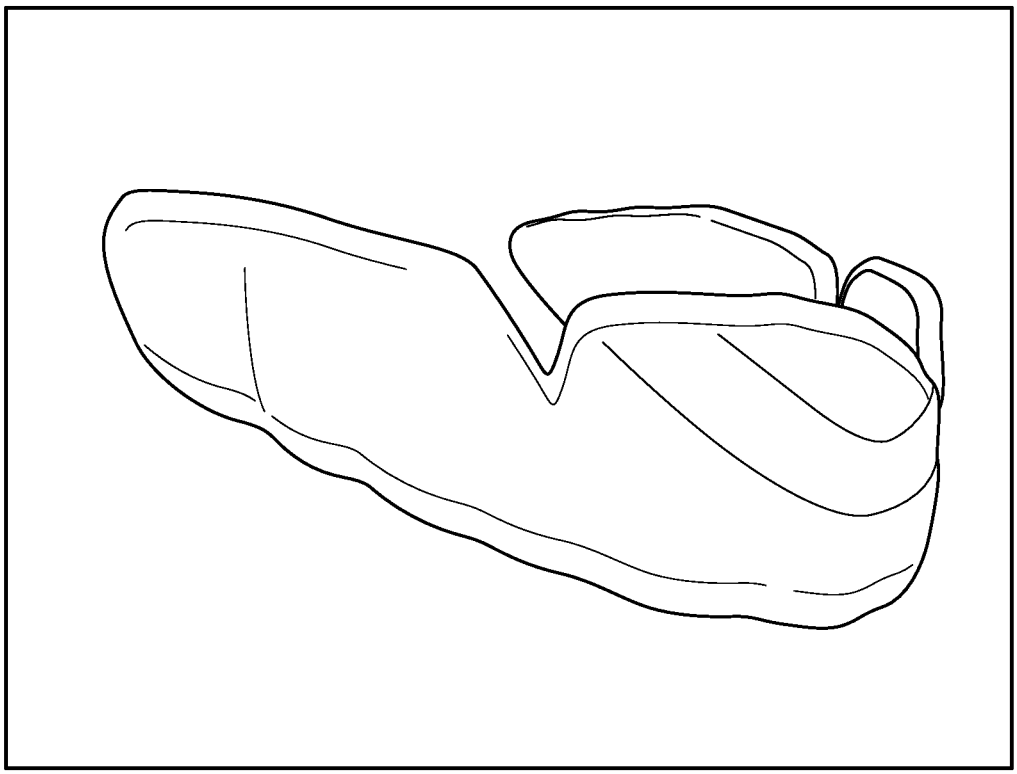
FIG. 4 is a schematic illustration showing a side view of one embodiment of the mouth guard described herein, shows a buccal frenum attachment relief.
Figure 5:
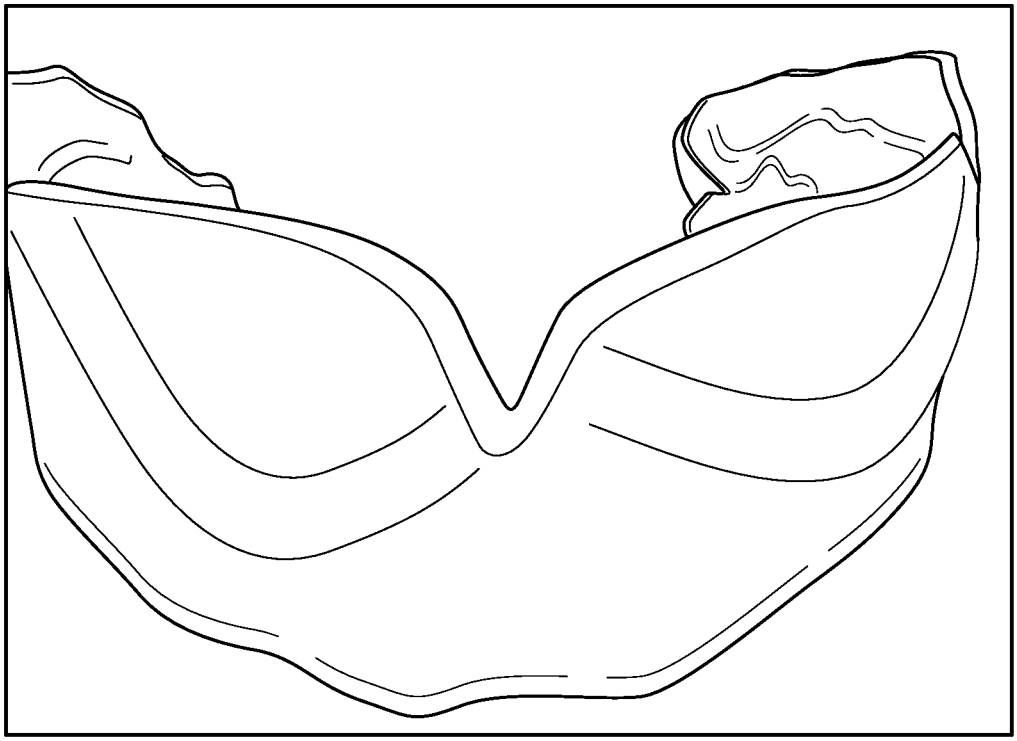
FIG. 5 is a schematic illustration showing the anterior portion of one embodiment of the mouth guard described herein, resting on a model of a wearer's upper dentition. The schematic illustration shows an anterior frenum attachment relief
Figure 9:
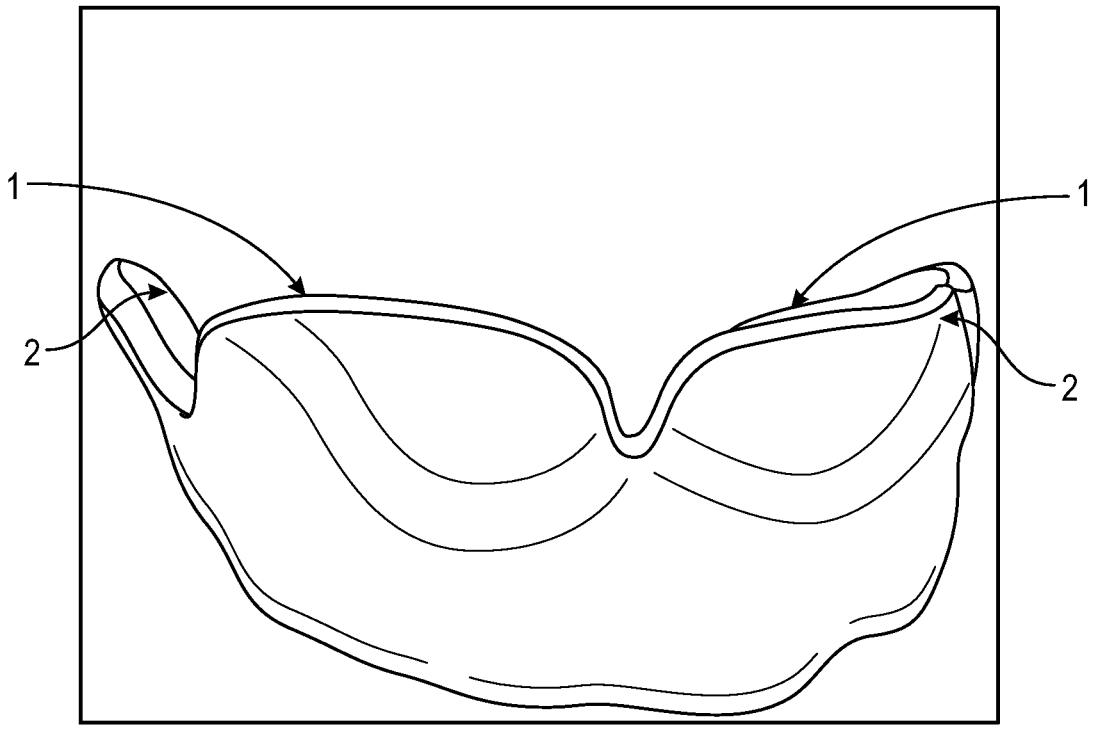
FIG. 9 is a schematic illustration showing a frontal view of one embodiment of the mouth guard described herein. The schematic illustration shows the facial border (1) and the buccal border (2), as well as a frenum relief

(1) Buccal and Facial Borders should be "thinned" and extend beyond the height of contour of the attached gingiva (FIGS. 3, 5, 9). When necessary, a "frenum relief" should be made (See FIGS. 3-5 and 9).

Figure 6:
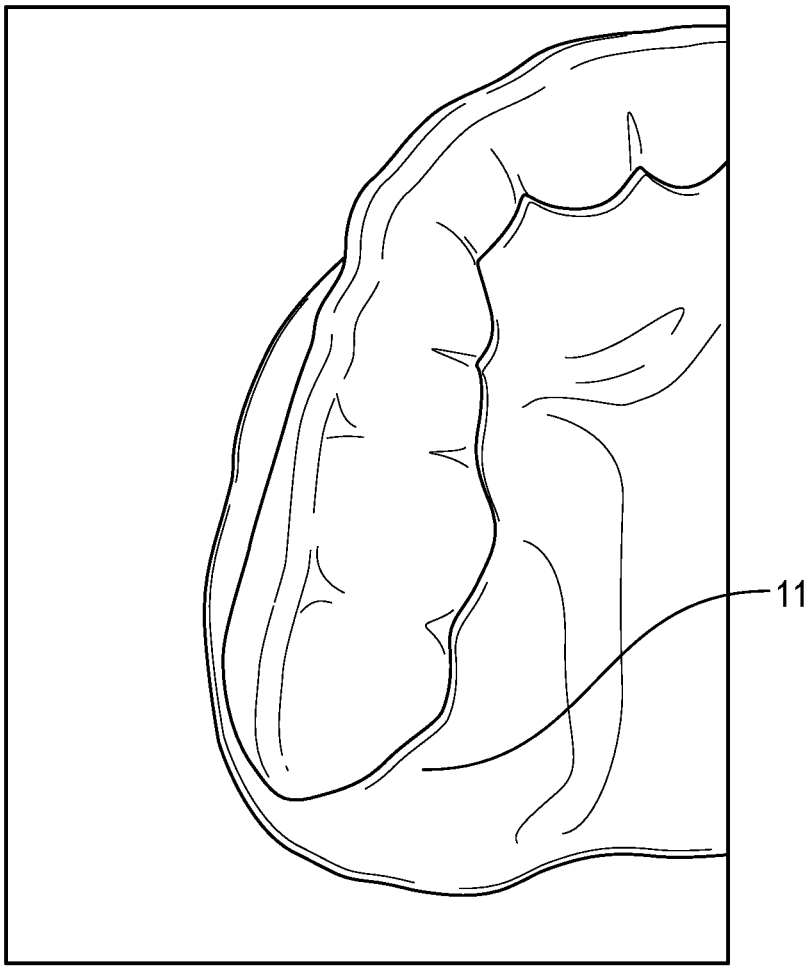
FIG. 6 is a schematic illustration showing a partial bottom view of one embodiment of the mouth guard described herein, resting on a model of a wearer's upper dentition. The schematic illustration shows a distal extension (11) on the maxillary molar.

(2) The Distal Extensions should cover the entire last maxillary molars (bilaterally) and seat firmly on the gingival tissue distal to the last upper molar (See FIG. 6).

(3) The Occlusal Surface of the maxillary premolars and molars should be covered in its entirety and maintain the thickness of the mouth guard material (See FIG. 6).

Figure 7:
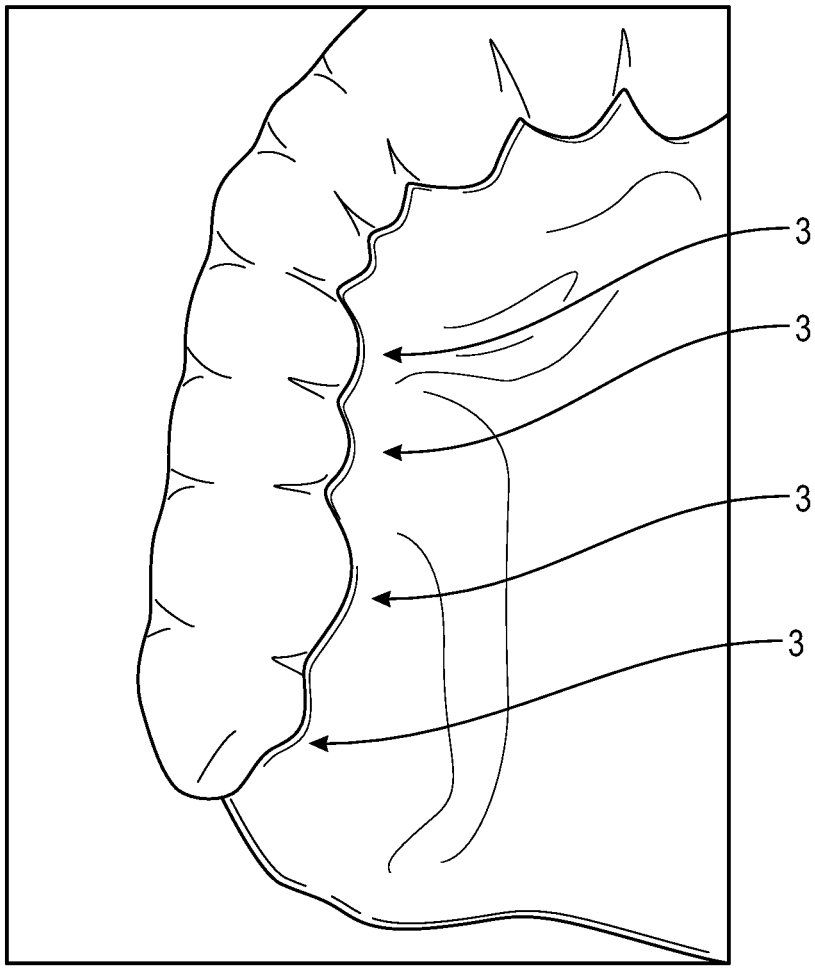
FIG. 7 is a schematic illustration showing a bottom view of one embodiment of the mouth guard described herein, resting on a model of a wearer's upper dentition. The schematic illustration shows a scalloped palatal finish line on the palatal surfaces of the maxillary premolars and molars, with scallops (3) shown with arrows.

(4) The Palatal Surface of the maxillary premolars and molars should be covered in its entirety and the gingival-palatal margins "scalloped" to the gingival architecture (See FIG. 7).

Figure 8:
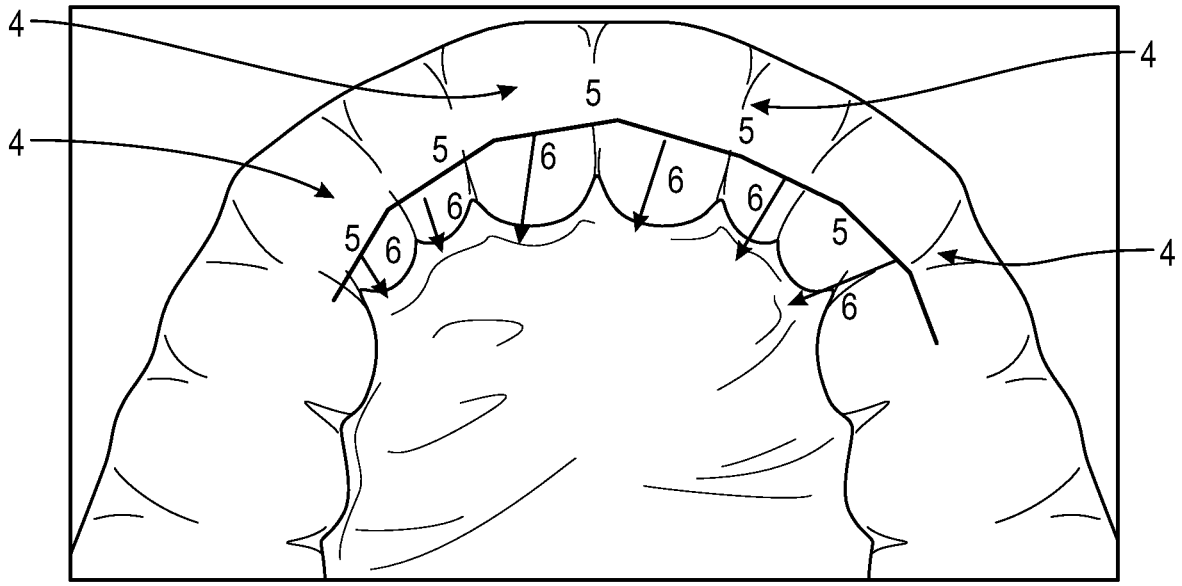
FIG. 8 is a schematic illustration showing the bottom view of the anterior portion of one embodiment of the mouth guard described herein, resting on a model of a wearer's upper dentition. The schematic illustration shows how the mouth guard maintains its thickness on the biting surface of the anterior teeth, and from a portion of the lingual/palatal surface of the anterior teeth from the incisal edge/cusp tip toward the gingiva (4). It also shows the concave/sloped/slanted thinning of the mouth guard as it approaches the gingiva. As shown, the thickness of the incisal surface (approximately 40-50% of the distance from the biting surfaces to the gingiva) (5) is around 3-4 mm. The remainder of the lingual/palatal surface (the rest of the distance to the gingiva, or remaining 50-60% (6) is thinned out to between around 25% and 35% of the maximum thickness in other portions of the mouth guard.

(5) The Incisal Edges of the maxillary central and lateral incisors should be covered in its entirety and maintain the thickness of the mouth guard material (See FIG. 8).

(6) The Cusp Tips of the maxillary canines should be covered in its entirety and maintain the thickness of the mouth guard material (See FIG. 8).

(7) An "Innovative Ramp Design" specific and unique to the "Comfort Mouth guard" covers the palatal surface of the maxillary central and lateral incisors and the maxillary canines. The "Innovative Ramp Design" is fabricated with the following specifications: (a) in one aspect, 3-4 mm to at most one-third (the incisal one-third) of the lingual/palatal surface of the maxillary central and lateral incisors and the maxillary canines, and in another aspect, between around 40 to around 50% of the lingual/palatal surface from the incisal edge/cusp tip toward the gingiva of the maxillary central and lateral incisors and the maxillary canines, should be covered and maintain the thickness of the mouth guard material and (b) the remaining palatal surface (in one aspect, approximately, the gingival two-thirds, and in another aspect, the remaining around 50 to around 60%) of the lingual/palatal surface of the maxillary central and lateral incisors and the maxillary canines should be concave or sloped (slanted), "thinning" to the gingival margin, and the gingival-palatal margins "scalloped" to the gingival architecture (See FIGS. 8 and 10).

This embodiment of the mouth guard is shown in a series of attached figures, which are described below.

FIG. 3 is a schematic illustration showing the front view of one embodiment of the mouth guard described herein, resting on a model of a wearer's upper dentition. The schematic illustration shows the facial border (1) and the buccal border (2).

FIG. 4 is a schematic illustration showing a side view of one embodiment of the mouth guard described herein, shows a buccal frenum attachment relief.

FIG. 5 is a schematic illustration showing the anterior portion of one embodiment of the mouth guard described herein, resting on a model of a wearer's upper dentition. The schematic illustration shows an anterior frenum attachment relief FIG. 6 is a schematic illustration showing a partial bottom view of one embodiment of the mouth guard described herein, resting on a model of a wearer's upper dentition. The schematic illustration shows a distal extension (11) on the maxillary molar.

FIG. 7 is a schematic illustration showing a bottom view of one embodiment of the mouth guard described herein, resting on a model of a wearer's upper dentition. The schematic illustration shows a scalloped palatal finish line on the palatal surfaces of the maxillary premolars and molars, with scallops (3) shown with arrows. The scalloping provides less material where the tongue of the wearer would normally reside, and as a result, the mouth guard is more comfortable than those where the material extends beyond where it is scalloped in the mouth guard described herein.

FIG. 8 is a schematic illustration showing the bottom view of the anterior portion of one embodiment of the mouth guard described herein, resting on a model of a wearer's upper dentition. The schematic illustration shows how the mouth guard maintains its thickness on the biting surface of the anterior teeth, and a portion of the lingual/palatal surface of the anterior teeth from the incisal edge/cusp tip toward the gingiva (4). It also shows the concave/sloped/slanted thinning of the mouth guard as it approaches the gingiva. As shown, the thickness of the incisal surface (a portion of the distance from the biting surfaces to the gingiva) (5) is around 3-4 mm, but can be as much as around 5 mm, depending on the dentist's recommendation, the wearer's preference, and the sport for which the mouth guard is used. The remainder of the lingual/palatal surface (the rest of the distance to the gingiva) (6) is thinned out to between around 25% and 35% of the maximum thickness in other portions of the mouth guard.

In various embodiments of the mouth guard described herein, the portion of the distance from the biting surfaces to the gingiva can be around 3 to around 4 mm, can be around one third of the distance, or can be from 40% to 50%. The remainder of the lingual/palatal surface (the rest of the distance to the gingiva) can be, for example, a) the difference between the entire distance between the biting surfaces to the gingiva and around 3 to around 4 mm, b) around two thirds of the distance, or c) around 50% to around 60% of the distance.

FIG. 9 is a schematic illustration showing a frontal view of one embodiment of the mouth guard described herein. The schematic illustration shows the facial border (1) and the buccal border (2), as well as a frenum relief. The mouth guard has border extensions. Border extensions are the anterior and posterior portions on the facial and buccal aspects of the mouth guard that extend up into the mucco-buccal fold areas.

Figure 10A:
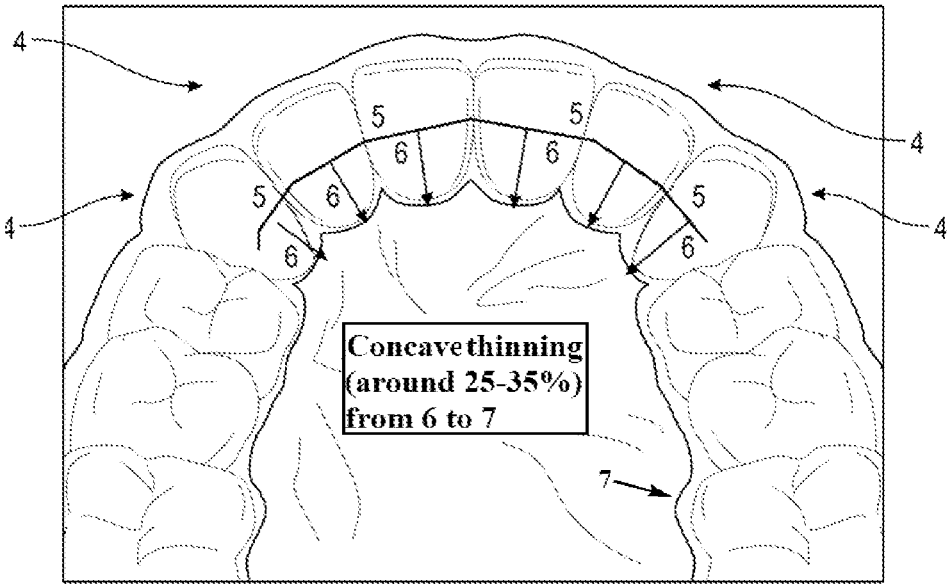
FIGS. 10A-C are schematic illustrations of a clear mouth guard, which best shows how the material maintains a constant thickness (4) until the border (6), which is approximately a third or around 40-50% of the way from the anterior portion of the mouth guard configured to contact the wearer's incisal edge/cusp tip toward the portion of the anterior portion configured to contact the wearer's gingiva, then is thinner as it approaches the gingiva such that the thickness at the anterior portion configured to contact the wearer's gingiva is between around 25% and around 35% of the thickness of the portion of the anterior portion configured to cover the front surface of the wearer's teeth. The thickness at the incisal surface (part-way from the biting surface to the gingiva (5) is around 3-4 mm, and the remainder of the lingual/palatal surface (the rest of the distance to the gingiva) (6 to 7) is thinned out to between around 25% and 35% of the maximum thickness. The illustrations show a concave (FIG. 10A), sloped (FIG. 10B), and slanted (FIG. 10C) change in thickness from the border (6) to the gingival surface (7).
Figure 10B:
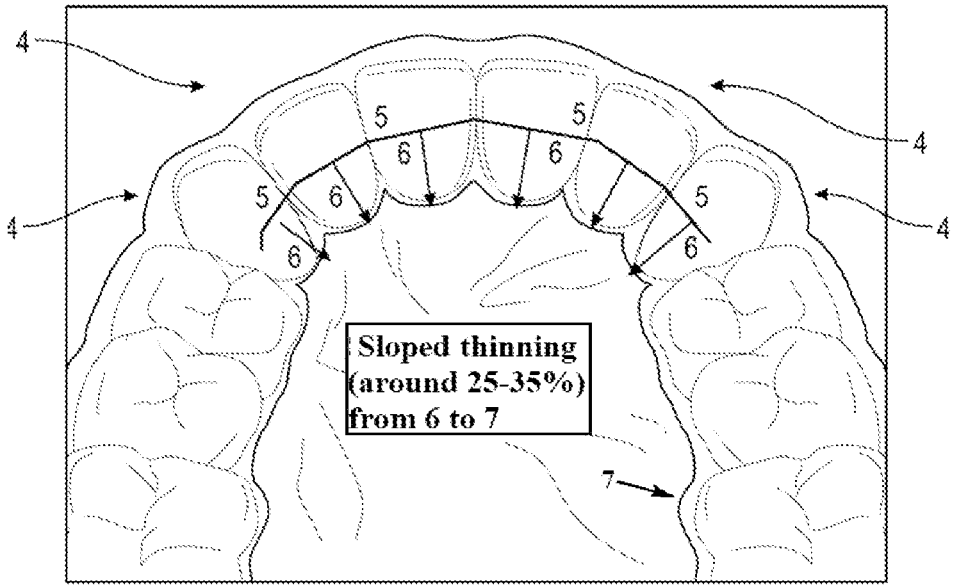
Figure 10C:
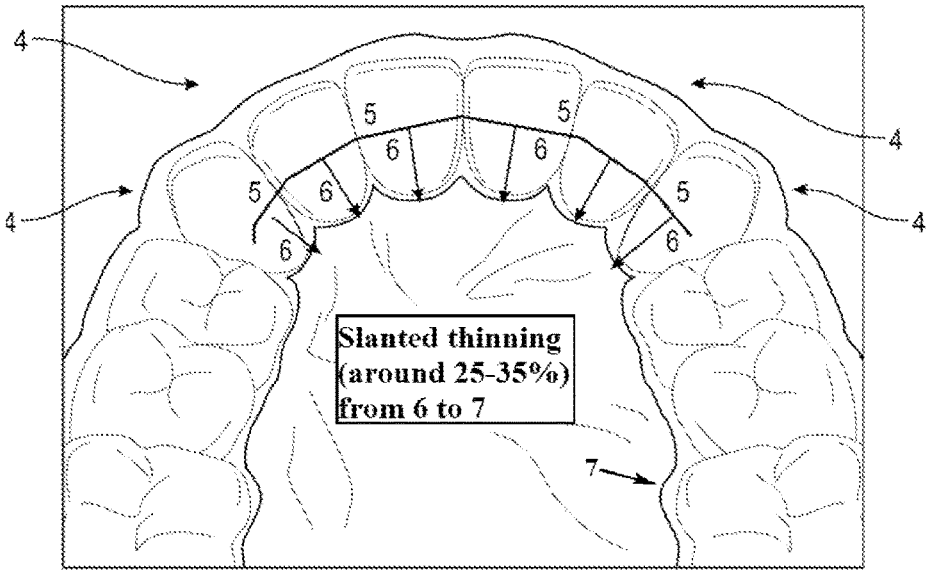

FIGS. 10A-C are schematic illustrations of a clear mouth guard, which best shows how the material maintains a constant thickness (4) until the border (5), then is thinner as it approaches the gingiva. The thickness at the incisal surface (a portion of the distance from the biting surface to the gingiva (5) is around 3-4 mm, and the remainder of the lingual/palatal surface (the rest of the distance to the gingiva) (6) is thinned out to between around 25% and 35% of the maximum thickness. The illustrations show a concave (FIG. 10A), sloped (FIG. 10B), and slanted (FIG. 10C) change in thickness.

As can be readily seen in the schematic illustrations, there is less opacity where the material is thinnest (6), and more opacity where the material is thickest (4), and the difference in opacity relates to the difference in the thickness of the material. In various embodiments, the portion of the distance from the biting surfaces to the gingiva can be around 3 to around 4 mm, can be around one third of the distance, or can be from 40% to 50% of the distance. The remainder of the lingual/palatal surface (the rest of the distance to the gingiva) can be, for example, a) the difference between the entire distance between the biting surfaces to the gingiva and around 3 to around 4 mm, b) around two thirds of the distance, or c) around 50% to around 60% of the distance.

Figure 11:
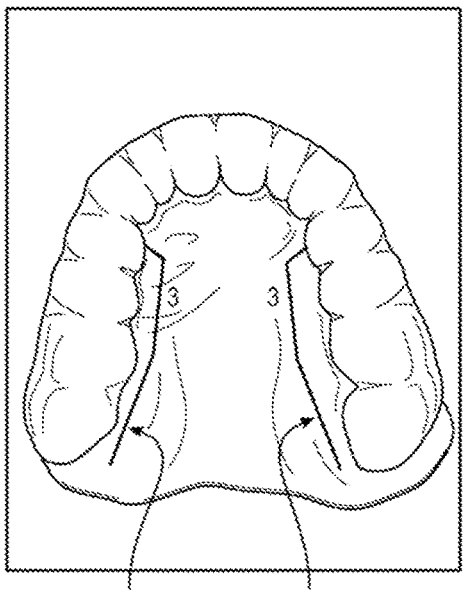
FIG. 11 is a schematic illustration showing a mouth guard with the ramp design described herein for the anterior teeth, combined a smooth palatal finish line for the maxillary premolars and molars. In one embodiment, the mouth guard has a smooth palatal finish line with a thickness less than or equal to around 4.0 mm.

FIG. 11 is a schematic illustration showing a mouth guard with the ramp design described herein for the anterior teeth, combined a smooth palatal finish line for the maxillary premolars and molars. In one embodiment, the mouth guard has a smooth palatal finish line with a thickness less than or equal to around 4.0 mm. In this schematic illustration, the palatal finish line extends only to the posterior teeth, but in another embodiment, not shown, the palatal finish line can also extend to the anterior teeth.

In this schematic illustration, scalloping all along the lingual/palatal surface is shown, and the palatal/lingual "finish line" is the border to which you would add additional material, in this embodiment, to aid in retention.

The schematic illustration also shows an anterior ramp on the front of the mouth guard, where 3-4 mm to at most one-third (the incisal one-third) of the lingual/palatal surface of the maxillary central and lateral incisors and the maxillary canines is covered and the thickness of the mouth guard material maintained, while the remaining palatal surface (approximately, the gingival two-thirds) of the lingual/palatal surface of the maxillary central and lateral incisors and the maxillary canines is concave or sloped (slanted), "thinning" to the gingival margin.

Line 7 shows an area in which the mouth guard can be extended, beyond a scalloped region, to help retain the mouth guard in the wearer's mouth, with a border (3) marked to show the range of the extension. That is, scalloping the posterior teeth can make for a more comfortable mouth guard, but the mouth guard may be more difficult to retain. Extending the region to the purple lines can aid in retaining the mouth guard, while having little impact on the wearer's ability to speak, breathe, and drink with comfort. This may be helpful in aiding in retention where patients have certain arch forms.

Example 2

Clinical Studies with High School, College, Professional and Extreme Sports Athletes As described herein, the mouth guard described herein allows the athlete to speak, breathe, and drink with comfort. Additionally, athletes can wear this mouth guard comfortably for long periods of time, for instance, two to three hours at a time, without the need to constantly take it in and out of their mouths, between "plays" or short periods of time.

Confidential clinical research studies involving seven groups of athletes were conducted, where the athletes included: (1) a Men's NCAA Division I Basketball Team, (2) members of an NCAA Division I Women's Field Hockey Team, and (3) members of an NCAA Division I Women's Lacrosse Team, (4) two extreme winter sports athletes, (5) a girls' high school softball pitcher, (6) a professional baseball catcher and (7) an Alabama high school football player.

Each group of athletes participated in two clinical research projects. These research projects included: (1) A Quality Assessment of Mouth guard Usage Study and (2) A Compliance of Usage Study. On information and belief, and after a review of the literature, it appears that no prior studies of this nature regarding the use or evaluation of a specific mouth guard have been conducted.

These studies were conducted to determine if the results would support the claims that the mouth guard described herein allows the athlete to speak, breathe, and drink with comfort, and that athletes can wear the mouth guard described herein comfortably for extended periods of time, without the need to constantly take it in and out of their mouths in between "plays" or short periods of time.

Men's NCAA Division I Basketball Team

Twelve out of fifteen members of the Men's NCAA Division Basketball Team voluntarily participated in these confidential clinical studies.

Prior to the start of the basketball season, the basketball players had dental impressions taken by a dentist. The dental impressions were sent to the dental laboratory and the dental laboratory technician poured up and trimmed the dental molds and fabricated the new prototype mouth guard according to the specifications described herein.

The goal of the study was to verify that the mouth guard described herein allows players to speak, breathe and drink with comfort, and that the mouth guard can comfortably be worn without the need to constantly take it in and out of their mouths between "plays" or short periods of time.

These qualities are important for basketball players, as there is a need for each basketball player to be able to speak easily and communicate with their teammates, as well as to breathe comfortably and efficiently, since they are nearly always running, and remain in constant motion.

Quality Assessment of Mouth Guard Usage Study

This research project was conducted during the 2015-2016 NCAA College Basketball Season. Twelve of the fifteen members of the Men's Basketball Team voluntarily participated in this study. This research project started on Oct. 1, 2015, the first official day of practice and was completed Mar. 5, 2016, the end of the last regular season game. The research study lasted greater than five months.

Following usage of the new prototype mouth guard, each player anonymously completed a "Mouth guard Usage Survey" containing fourteen questions.

A similar survey was provided to the other athletes described in this example, though the survey may include more or fewer questions.

Surveys were completed at the end of Week #1, at the end of Week #2, and at the End of the Season. The survey was distributed to and collected from the basketball players by the Men's Basketball Head Athletic Trainer. The data was collected, organized and analyzed by an individual trained in biostatistics. After any player had worn the new prototype mouth guard one time, he was allowed: (1) to withdraw from the study (2) not wear new mouth guard any more or (3) go back to wearing his previous mouth guard (if he had one). All of the twelve players who initially started in the study remained in the study and participated in it for the entire length of the study. Each participating player wore the new prototype mouth guard during the entire length of the study and never switched back to their old type of mouth guard even if he had one.

Questions #3, #4 and #5 assess the Men's Basketball Players' ability to Speak, Breathe and Drink with the new prototype mouth guard in place. The players graded the ability to "Speak", while playing basketball with the mouth guard in place, on a scale of 1 (nobody can understand me) to 5 (some words are hard to understand) to 10 (the same with it in or out). The players graded the ability to "Breathe", while playing basketball with the mouth guard in place, on a scale of 1 (gasping for air) to 10 (the same with it in or out). The players graded the ability to "Drink", while playing basketball with the mouth guard in place, on a scale of 1 (impossible) to 10 (the same with it in or out). The results for Question #3—"Ability to Speak" were 8.5 for Week #1, 8.0 for Week #2, and 7.7 at the End of the Season. The results for Question #4—"Ability to Breathe" were 8.1 for Week #1, 7.8 for Week #2, and 8.4 at the End of the Season. For Question #5 "Ability to Drink" were 8.2 for Week #1, 7.8 for Week #2, and 7.4 at the End of the Season.

Figure 12:
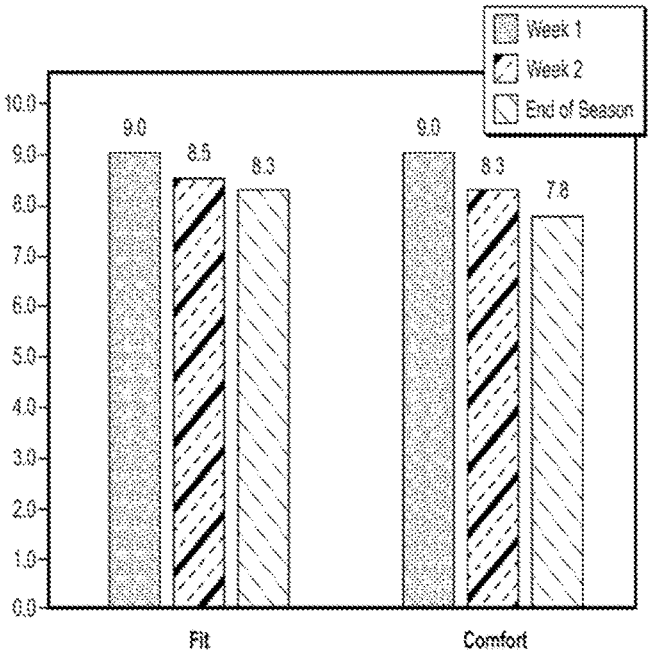
FIG. 12 is a chart summarizing survey results of how a team of men's basketball players perceived the fit and comfort of one embodiment of the mouth guard described herein. Results after one week are shown in black, results after two weeks are shown in gold, and results at the end of the basketball season are shown in white.
Figure 13:
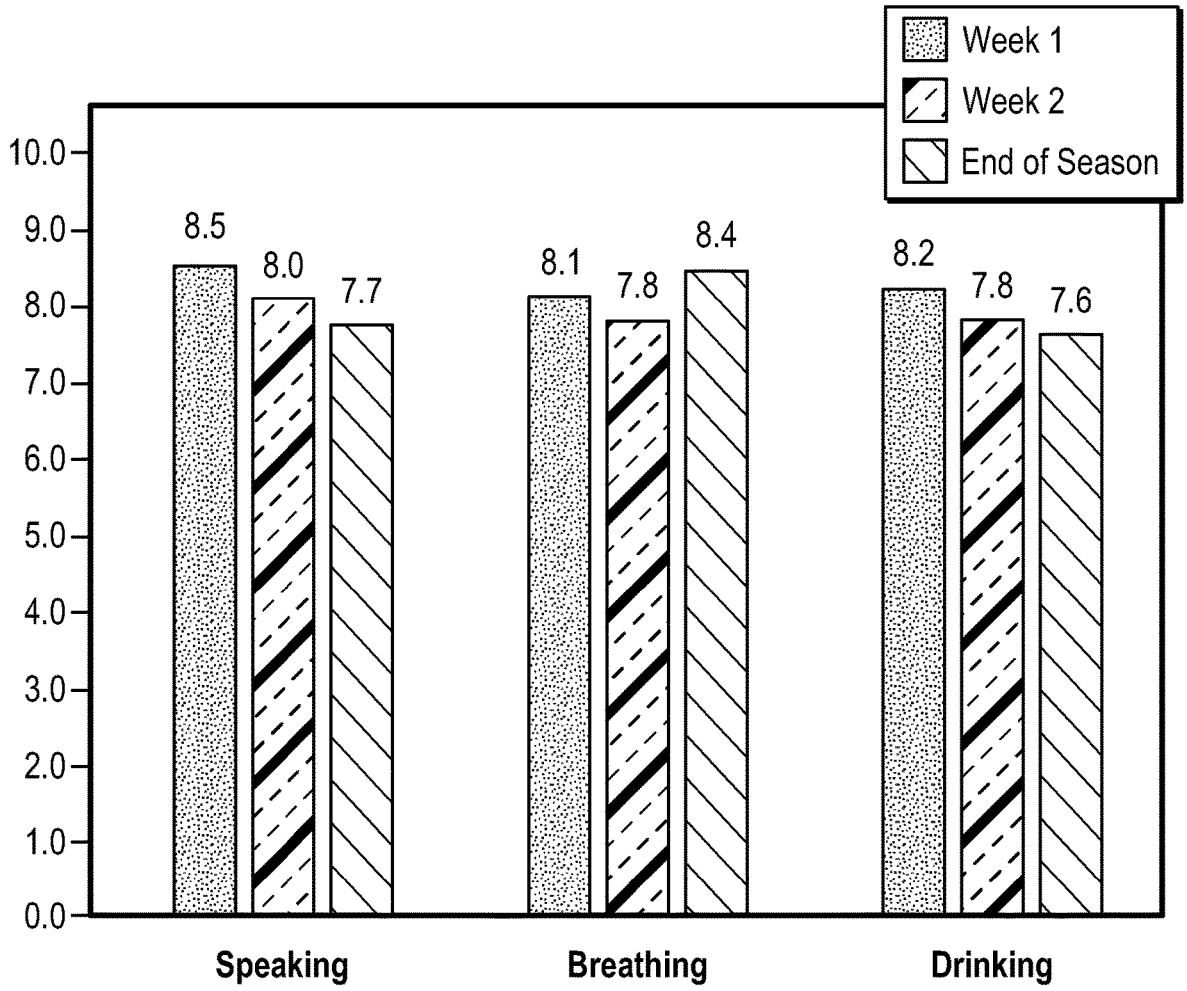
FIG. 13 is a chart summarizing survey results of how a team of men's basketball players perceived the ease of speaking, breathing, and drinking while wearing one embodiment of the mouth guard described herein. Results after one week are shown in black, results after two weeks are shown in gold, and results at the end of the basketball season are shown in white.
Figure 14:
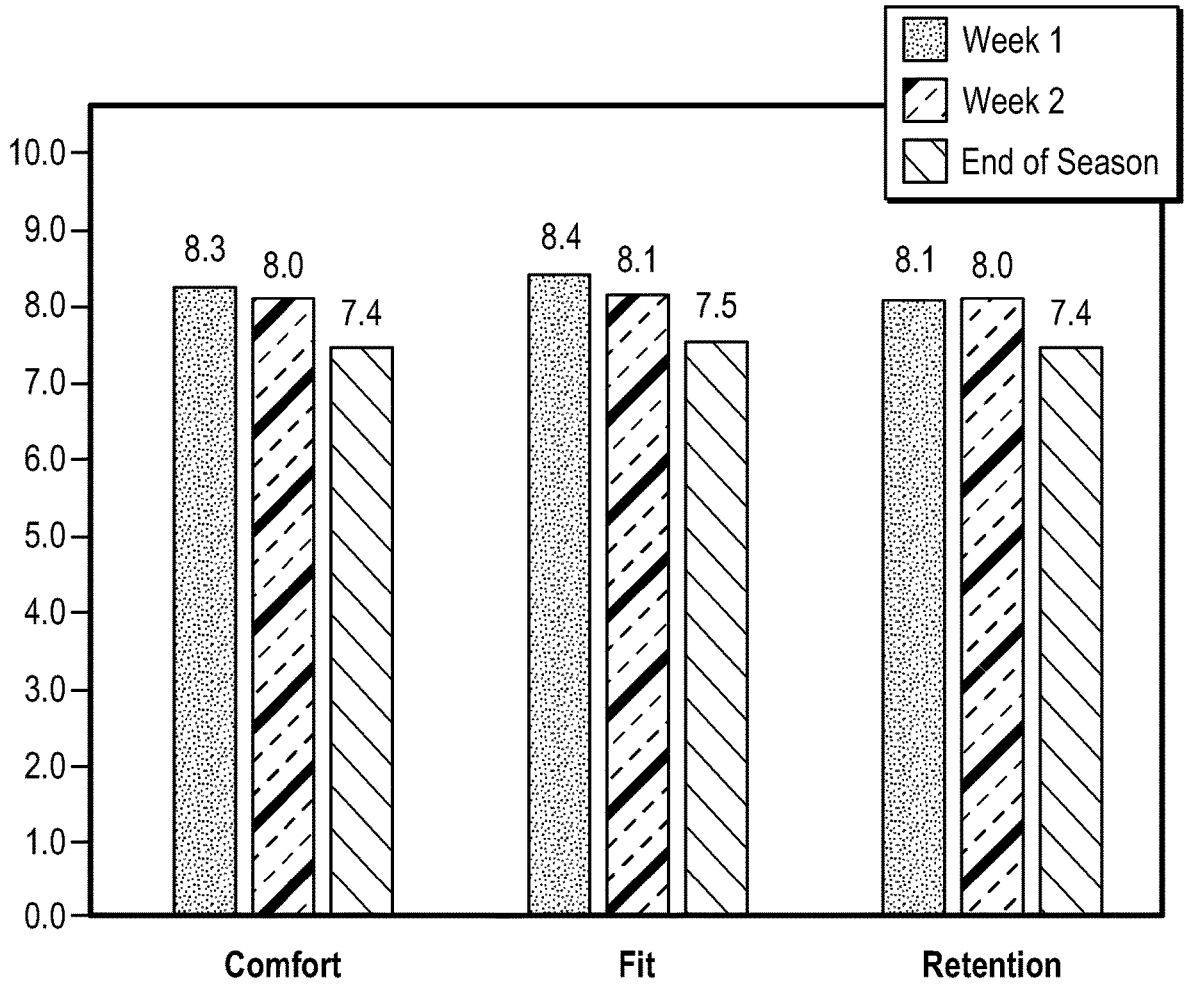
FIG. 14 is a chart summarizing survey results of how a team of men's basketball players perceived the fit, comfort, and ease of retention of one embodiment of the mouth guard described herein. Results after one week are shown in black, results after two weeks are shown in gold, and results at the end of the basketball season are shown in white.

These results were very favorable and clearly demonstrate that the basketball players felt that the mouth guards had a good fit and were comfortable (FIG. 12), that they were able to speak, breathe, and drink with comfort while wearing this new prototype mouth guard (FIG. 13), and that they were able to retain the mouth guards (FIG. 14).

Compliance of Usage Study

As previously mentioned, after any player had worn the new prototype mouth guard one time, he was allowed: (1) to withdraw for the study (2) not wear new mouth guard any more or (3) go back to wearing his previous mouth guard (if he had one). All of the twelve players who initially started in the study remained in the study and participated in it for the entire length of the study. Each participating player wore the new prototype mouth guard during the entire length of the study and never switched back to their old type of mouth guard even if he had one.

Without the players' knowledge, the Men's Basketball Head Athletic Trainer observed and recorded the players' use of the new prototype mouth guard both during Practice Sessions and as well during Game Participation. This information was collected and recorded for the entire length of the study. "Compliance Assessment" was determined and calculated by dividing the total number of times that the new prototype mouth guard was actually worn by the total number of actual opportunities that the mouth guard could have been worn. When an athlete could not participate in a Practice Session or play in a Game, these "lost opportunities" were subtracted from the "initial projected number of opportunities". Thus, the total number of actual opportunities for the new prototype mouth guard to be worn during "Practice Sessions and Game Participation" was 1,382 (Table 1).

TABLE 1

| Opportunities to Wear a Mouth guard - Practices & Games | |
|---|---|
| Total Projected | 1,476 |
| Lost due to Injury | −94 |
| Total Actual Opportunities | 1,382 |
| Total Actual Opportunities | 1,382 - Practices & Games |
| Total Time Worn | 1,280 |

93% Compliance Wearing New Prototype

*10/12 Participants Wanted to Wear the Mouth Guard Next Season*

Similarly, the total number of actual opportunities for the new prototype mouth guard to be worn during "Game Participation" was 324 (Table 2).

TABLE 2

| Opportunities to Wear a Mouth guard - Games | |
|---|---|
| Total Projected | 384 |
| Lost due to Injury | −60 |
| Total Actual Opportunities | 324 |
| Total Actual Opportunities | 324 - Games |
| Total Time Worn | 324 |

100% Compliance Wearing New Prototype

*10/12 Participants Wanted to Wear the Mouth Guard Next Season*

Compliance of Use for the new prototype mouth guard by the Men's Basketball Players was calculated for both "Practice Sessions and Games" as well as "Game Participation" for the 2015-2106 Basketball Season.

There was a 93% "Compliance of Use" for Men's Basketball Players wearing the new prototype mouth guard during "Practice Sessions and Game Participation" for the entire basketball season. The mouth guard was worn 1,280 times out of 1,382 actual opportunities. There was a 100% "Compliance of Use" for VCU Men's Basketball Players wearing the new prototype mouth guard during "Game Participation" for the entire basketball season. The mouth guard was worn 324 times out of 324 actual opportunities. Basketball players, by the nature of their game, cannot remove their mouth guards in between each play. Their game is one of "constant motion", once they enter a game and are "on the court". The results of this "Compliance of Use Study" are excellent and clearly demonstrate that athletes can wear this mouth guard comfortably for extended periods of time without the need to constantly take it in and out the their mouths in between "plays" or short periods of time.

SUMMARY

Studies of this nature, a "Quality Assessment of Mouth guard Usage Study" and a "Compliance of Usage Study" do not appear in the literature. While many types of mouth guards are sold on the market today, no mouth guard has been evaluated in such a manner as this prototype mouth guard. At the end of these clinical studies, the players anonymously completed a one-question survey asking them if they wanted to wear this new prototype mouth guard again next season. Similarly, the survey was distributed to and collected from the basketball players by the Men's Basketball Head Athletic Trainer. The results of the survey were that 10 out of the 12 basketball players who participated, wanted to wear the new prototype mouth guard next season.

Figure 15:
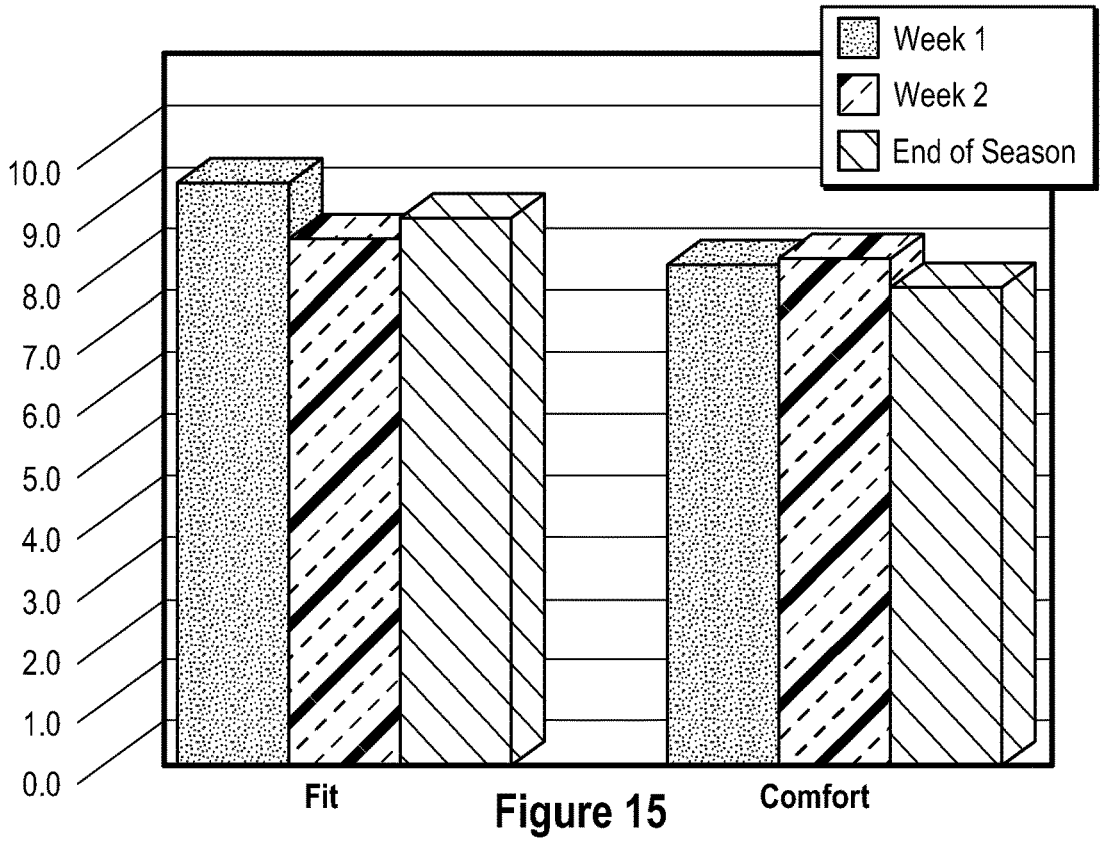
FIG. 15 is a chart summarizing survey results of how a team of women's field hockey players perceived the fit and comfort of one embodiment of the mouth guard described herein. Results after one week are shown in red, results after two weeks are shown in yellow, and results at the end of the field hockey season are shown in blue.
Figure 16:
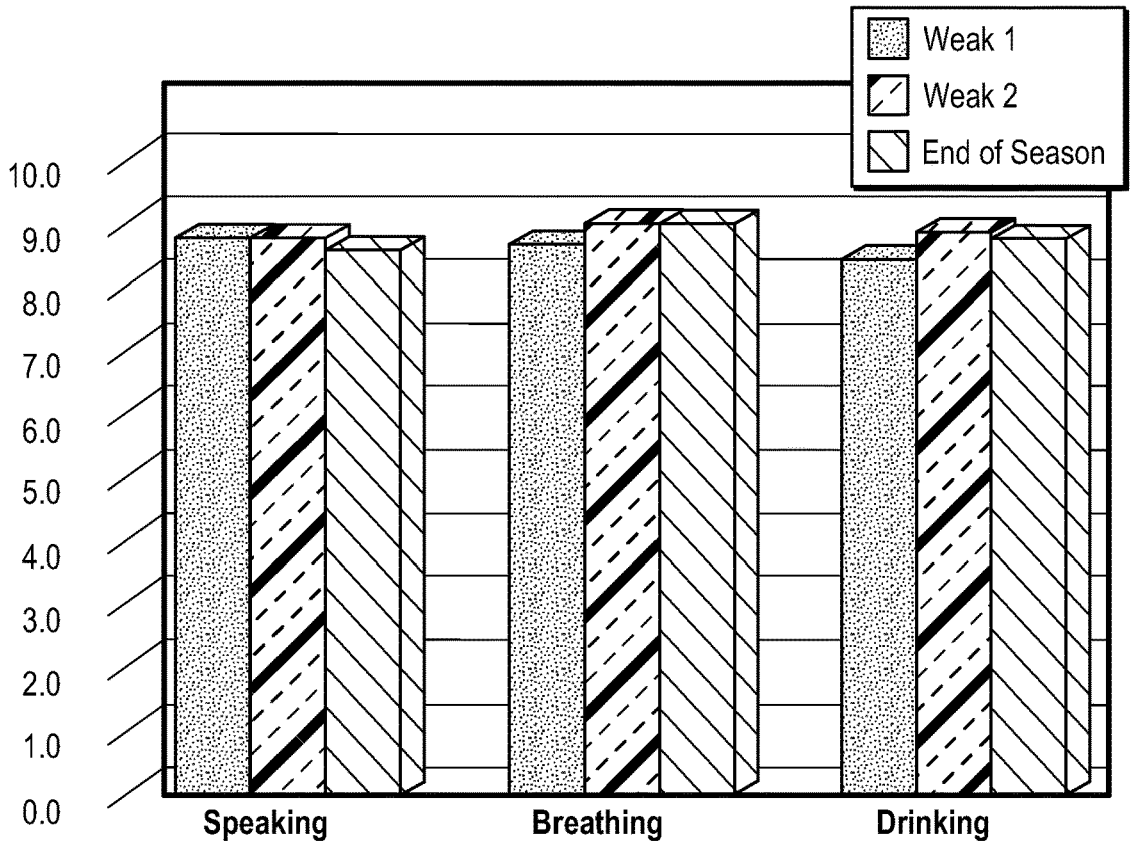
FIG. 16 is a chart summarizing survey results of how a team of women's field hockey players perceived the ease of speaking, breathing, and drinking while wearing one embodiment of the mouth guard described herein. Results after one week are shown in red, results after two weeks are shown in gold, and results at the end of the field hockey season are shown in blue.

The next set of athletes evaluated was a Women's Field Hockey Team. They were similarly evaluated for fit and comfort (FIG. 15), and ease of speaking, breathing, and drinking (FIG. 16). The results are tabulated in Tables 3 and 4.

TABLE 3

| Opportunities to Wear a Mouth guard - Practices & Games | |
|---|---|
| Total Projected | 486 |
| Lost due to Injury (1) | −53 |
| Lost due to Adjustment (1) | −17 |
| Total Actual Opportunities | 416 |

TABLE 4

| | |
|---|---|
| Total Actual Opportunities | 416 - Practices & Games |
| Total Time Worn | 416 |

100% Compliance Wearing New Prototype

*All Participants Wanted to Wear the Mouth Guard Next Season*

| Opportunities to Wear a Mouth guard - Games | |
|---|---|
| Total Projected | 162 |
| Lost due to Injury (1) | −18 |
| Lost due to Adjustment (1) | −5 |
| Total Actual Opportunities | 139 |
| Total Actual Opportunities | 139 - Games |
| Total Time Worn | 139 |

100% Compliance Wearing New Prototype

*All Participants Wanted to Wear the Mouth Guard Next Season*

Figure 17:
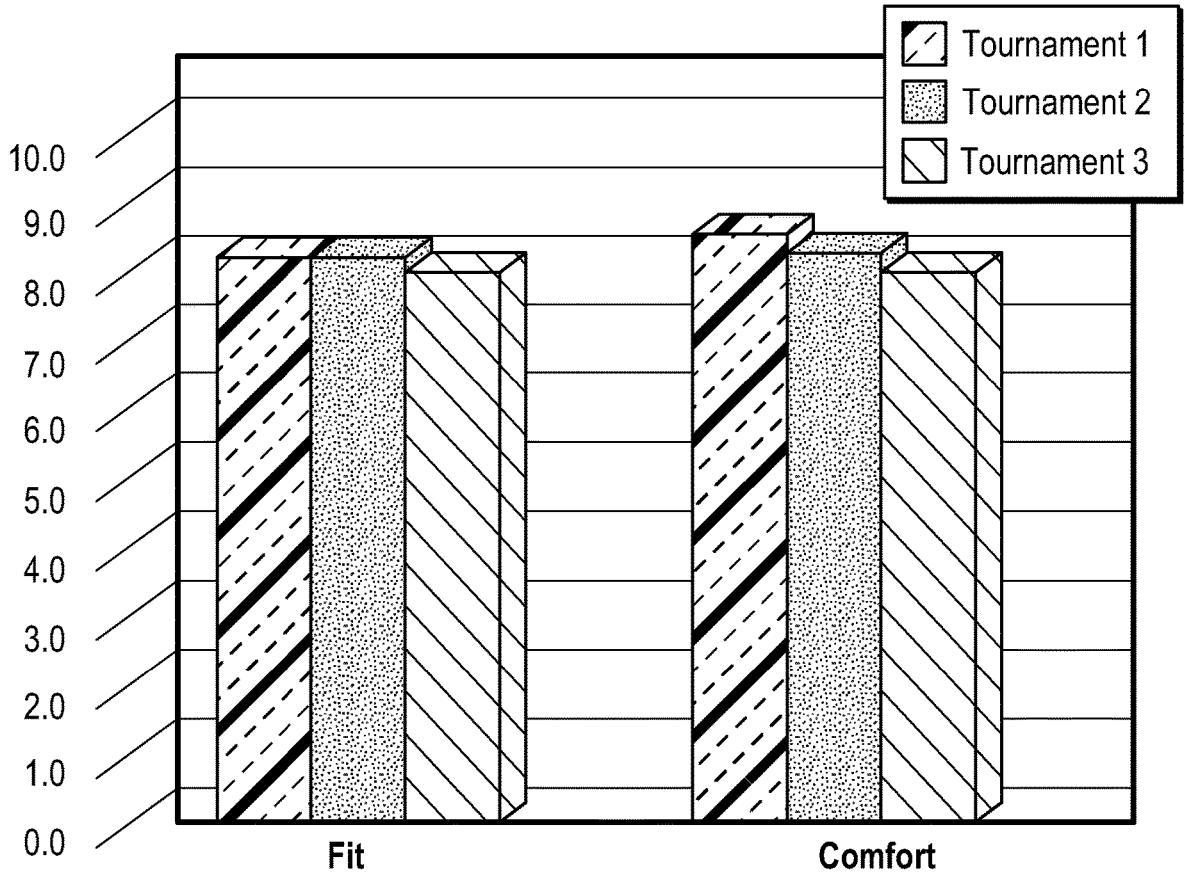
FIG. 17 is a chart summarizing survey results of how a team of women's lacrosse players perceived the fit and comfort of one embodiment of the mouth guard described herein. Results after one week are shown in blue, results after two weeks are shown in purple, and results at the end of the lacrosse season are shown in green.
Figure 18:
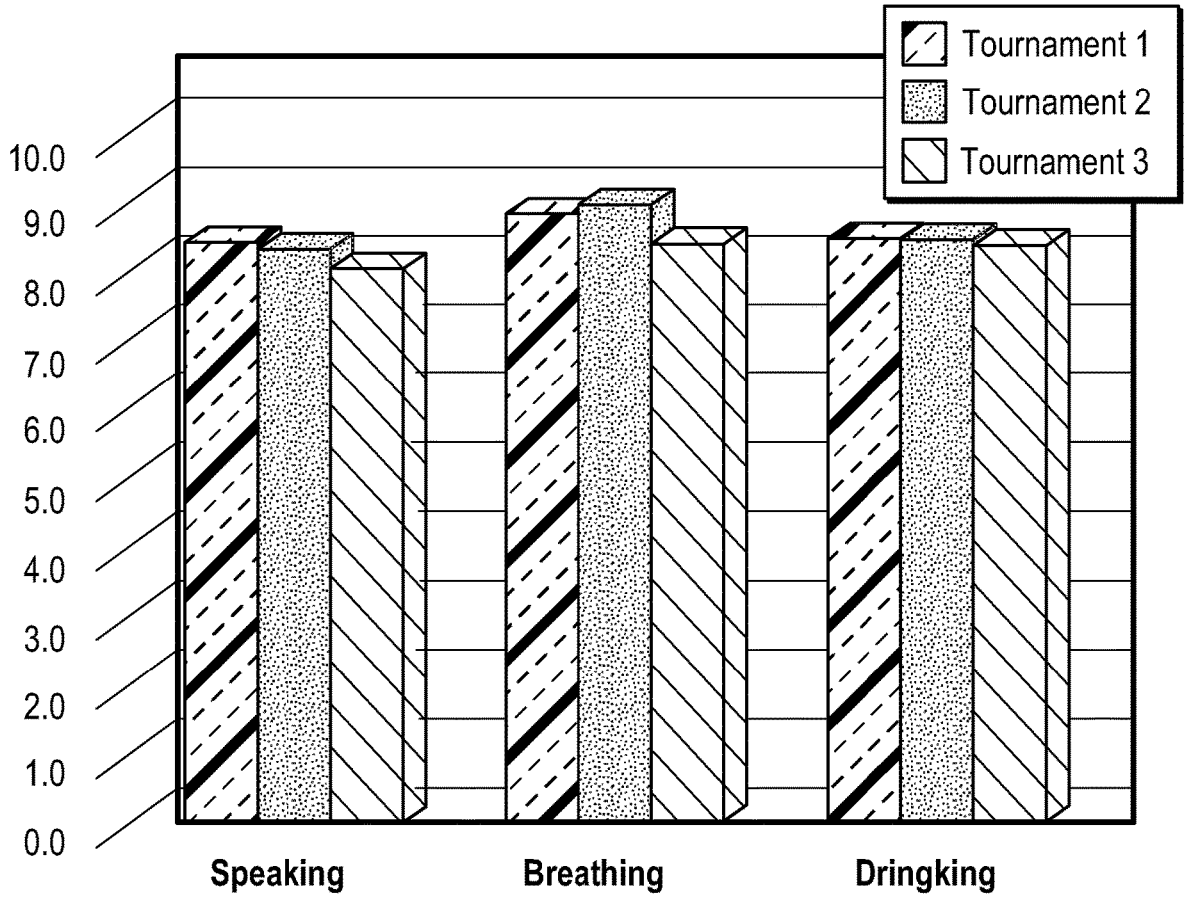
FIG. 18 is a chart summarizing survey results of how a team of women's lacrosse players perceived the ease of speaking, breathing, and drinking while wearing one embodiment of the mouth guard described herein. Results after one week are shown in blue, results after two weeks are shown in purple, and results at the end of the lacrosse season are shown in green.
Figure 19:
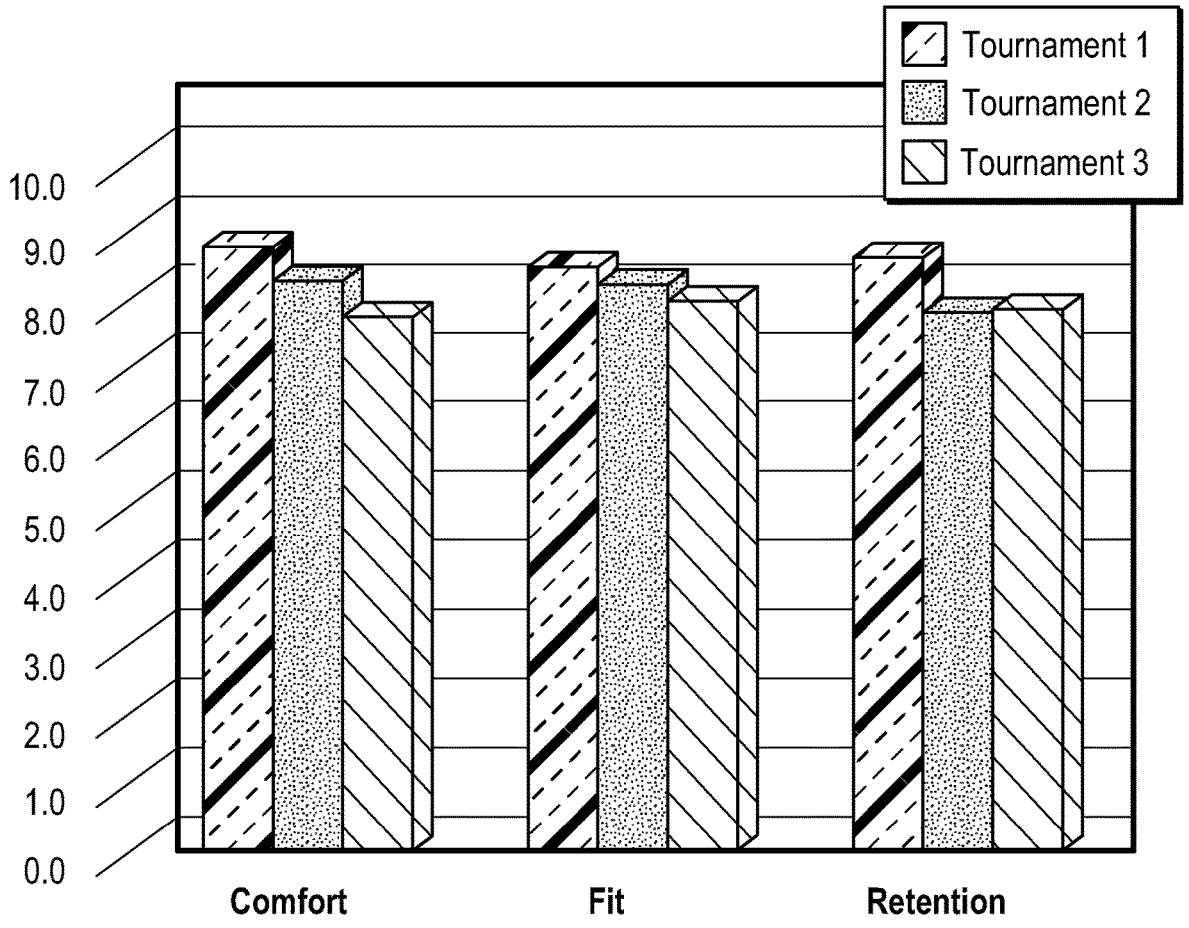
FIG. 19 is a chart summarizing survey results of how a team of women's lacrosse players perceived the fit, comfort, and ease of retention of one embodiment of the mouth guard described herein. Results after one week are shown in blue, results after two weeks are shown in purple, and results at the end of the lacrosse season are shown in green.

The next set of athletes evaluated was an NCAA women's lacrosse team. They were similarly evaluated for fit and comfort (FIG. 17), and ease of speaking, breathing, and drinking (FIG. 18), and fit/comfort/retention (FIG. 19). The results are tabulated in Tables 5 and 6.

TABLE 5

| Opportunities to Wear a Mouth guard - "Practice Sessions and Scrimmage Tournament Participation" | |
|---|---|
| Total Projected | 522 |
| Lost due to Injury (6) | −99 |
| Lost due to Unique Arch Form (1) | −29 |
| Lost: Athlete Lost Mouth guard then Found it (1) | −14 |
| Total Actual Opportunities | 380 |

TABLE 6

| | |
|---|---|
| Total Actual Opportunities | 380 - "Practice Sessions and Scrimmage Tournament Participation" |
| Total Time Worn | 380 |

100% Compliance Wearing New Prototype

*All Participants Wanted to Wear the Mouth Guard Next Season*

Similar results were observed in extreme winter sports athletes, who wore the mouth guard while snowboarding.

Two extreme winter sports athletes voluntarily participated in these confidential research projects. Prior to the start of the extreme winter sports season, these extreme sports athletes had dental impressions taken by a dentist. The dental impressions were sent to the dental laboratory and the dental laboratory technician poured up and trimmed the dental molds and fabricated the new prototype mouth guard according to the specifications. These athletes expressed excitement that a mouth guard would allow an athlete to speak, breathe and drink with comfort, and that it could comfortably be worn for long periods of time without the need to constantly take it in and out of their mouths between "runs" or short periods of time.

These qualities of the new prototype mouth guard were important for the athletes because, in "their style of sport", their participation exposes them to have their lower teeth hit forcefully up into the upper teeth when doing their "tricks" or in "landing". As a result, one of these participants, a couple of years ago, had previously cracked the cusps off of two molars and required two crowns to be made in order to restore the two fractured teeth. Additionally, these athletes were searching for and in need of a mouth guard that would allow them speak easily and communicate with their "running mates", to breathe comfortably and efficiently as well as for the mouth guard to be retentive and "stay in their mouth," as they are "always running in constant motion" while participating in their events and "challenges".

Quality Assessment of Mouth Guard Usage Study

This research project was conducted during the 2015-2016 Extreme Winter Sports Season. Two extreme winter sports athletes voluntarily participated in this study. This research project started in December, 2015 and was completed in March, 2016. Each player anonymously completed a "Mouth guard Usage Survey" containing ten questions, which was similar to the survey shown above in connection with the basketball players.

Figure 20:
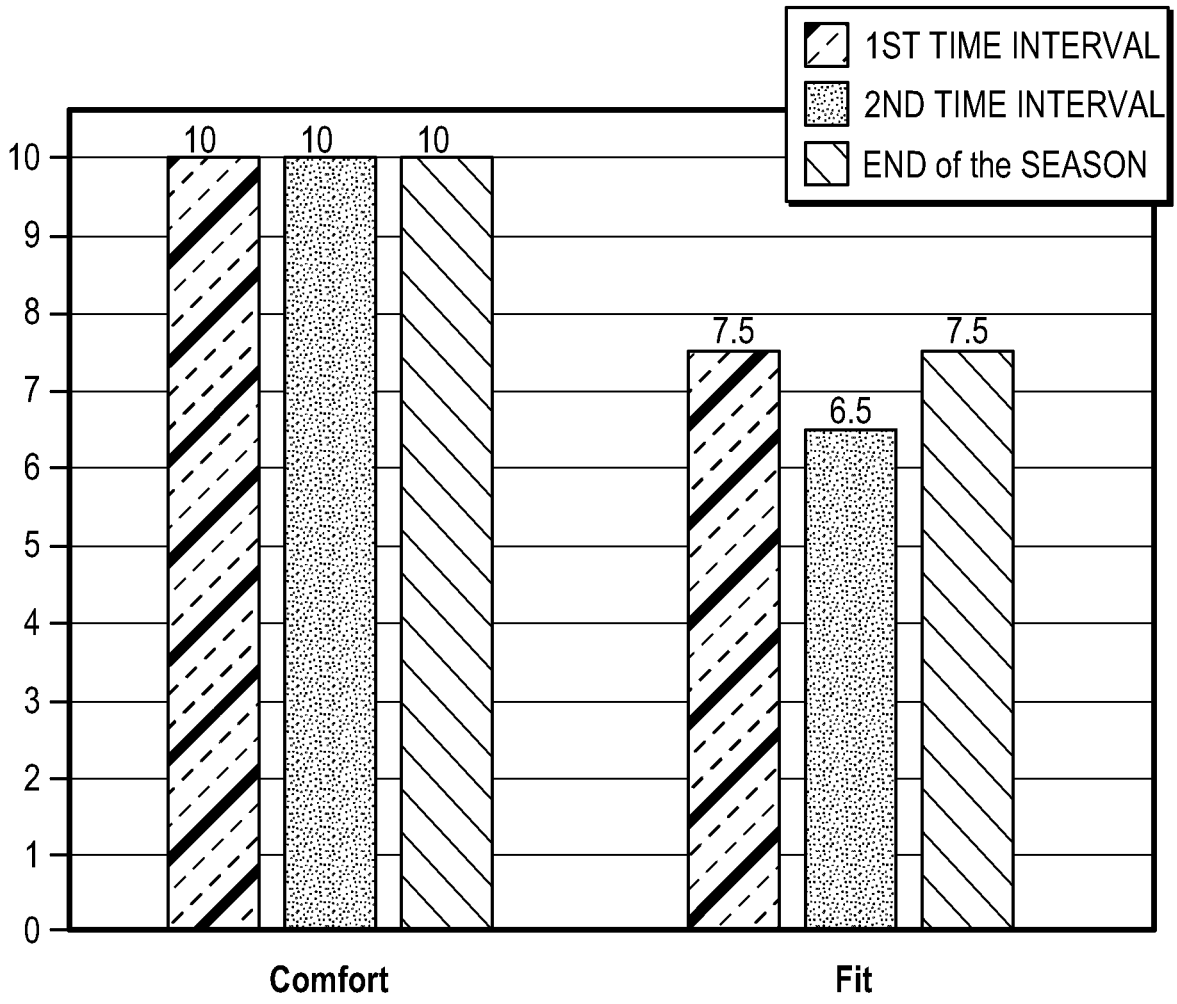
FIG. 20 is a chart summarizing survey results of how two extreme winter sports athletes perceived the fit and comfort of one embodiment of the mouth guard described herein. Results after a first time interval are shown in blue, after a second time interval in orange, and at the end of the season in grey.

Surveys were completed at three times during the extreme winter sports season. These two athletes "tested" out the new prototype mouth guard in the mountains with lower elevations in Virginia and West Virginia as well as in the mountains of higher elevations out West in Sun Valley, Id. The survey was completed by the athletes "on their own" and returned to the Principal Investigator at the conclusion of the study. The data was collected, organized and analyzed by an individual trained in biostatistics. After any athlete had worn the new prototype mouth guard one time, he was allowed: (1) to withdraw for the study and (2) not wear the new mouth guard any more. Both of the two athletes, who initially started in the study, continued to remain in the study and participated in it for the entire length of the study. Each participating player wore the new prototype mouth guard during the entire length of the study. As shown in FIG. 20, the athletes appreciated the comfort and fit of the mouth guard.

Figure 21:
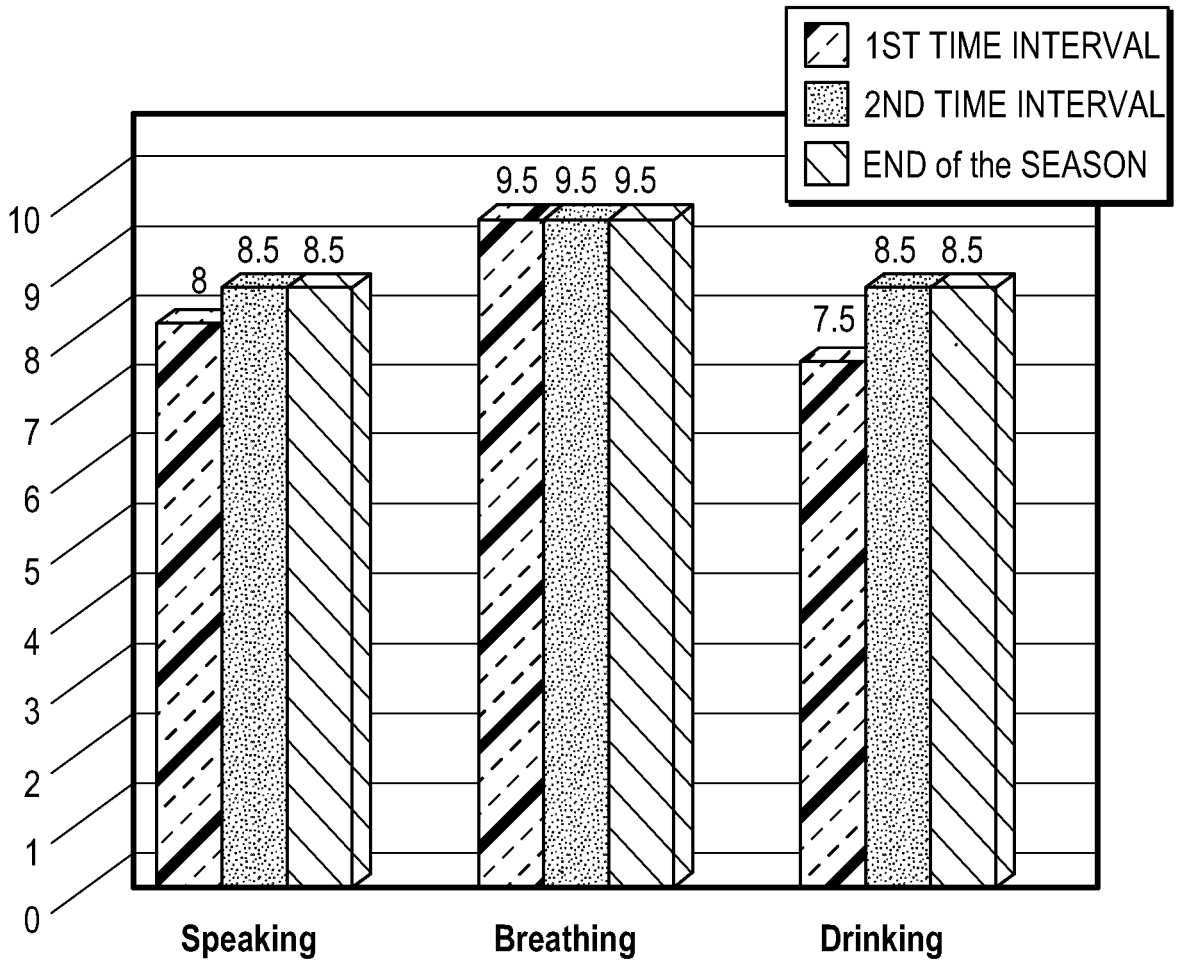
FIG. 21 is a chart summarizing survey results of how two extreme winter sports athletes perceived the ease of speaking, breathing, and drinking while wearing one embodiment of the mouth guard described herein. Results after a first time interval are shown in blue, after a second time interval in orange, and at the end of the season in grey.

Questions #3, #4 and #5 assessed the athletes' ability to speak, breathe and drink with the new prototype mouth guard in place. The athletes graded the ability to "Speak", while participating in their activities with the mouth guard in place, on a scale of 1 (nobody can understand me) to 5 (some words are hard to understand) to 10 (the same with it in or out). The players graded the ability to "Breathe", while participating in their extreme winter sports activities with the mouth guard in place, on a scale of 1 (gasping for air) to 10 (the same with it in or out). The players graded the ability to "Drink", while participating in their activities with the mouth guard in place, on a scale of 1 (impossible) to 10 (the same with it in or out). The results are depicted in FIG. 21.

The results for Question #3—"Ability to Speak" were for Field Trial #1—8.0, for Field Trial #2—8.5, and Field Trial #3—8.5. The results for Question #4—"Ability to Breathe" were for Field Trial #1—9.5, for Field Trial #2—9.5, and Field Trial #3—9.5. For Question #5 "Ability to Drink" were for Field Trial #1—7.5, for Field Trial #2—8.5, and Field Trial—8.5. These results were extremely favorable and clearly demonstrate that the athletes were able to Speak, Breathe, and Drink with Comfort while wearing this new prototype mouth guard. Additionally, these two athletes submitted two video commentaries, one from each one, giving highest accolades to the new prototype mouth guard. They stated that they wore the new prototype mouth guard for two to three hours straight at a time without taking it out of their mouths.

Compliance of Usage Study

As previously mentioned, after any athlete had worn the new prototype mouth guard one time, he was allowed: (1) to withdraw from the study and (2) not wear the new mouth guard. any more. Both of the two athletes who initially started in the study remained in the study and participated in it for the entire length of the study. Each participating athlete wore the new prototype mouth guard during the entire length of the study. This was extremely noteworthy because both athletes knew and realized the benefit a wearing a mouth guard when they participated in the extreme winter sports activities but had never been able to find a mouth guard that they were able to wear when participating in their sport. Now, these two athletes had found one, used it, and self-reported a Compliance Usage of 100% . . . they used it all of the time.

The results of this "Compliance of Use Study" are excellent and clearly demonstrate that athletes can wear this mouth guard comfortably for extended periods of time without the need to constantly take it in and out the their mouths in between "plays" or short periods of time.

At the end of these clinical studies, the extreme sports athletes anonymously completed a one-question survey asking them if they wanted to wear this new prototype mouth guard again next season. The results of the survey were that both of the athletes (2 out of the 2) who participated had a 100% compliance wearing the new mouth guard. Both participants indicated that they wanted to wear the new mouth guard next season. One of the athletes stated that: "The new mouth guard gave me added confidence during my performance". He went on further to state that: "The exposure for concussion/injury in snowboarding is high. The mouth guard provides confidence without sacrificing comfort". The two Extreme Winter Sports Athletes self-reported that they wore the new mouth guard during each "mountain run" during every trip in which they participated in their sport.

Girl's High School Softball Player

Figure 22:
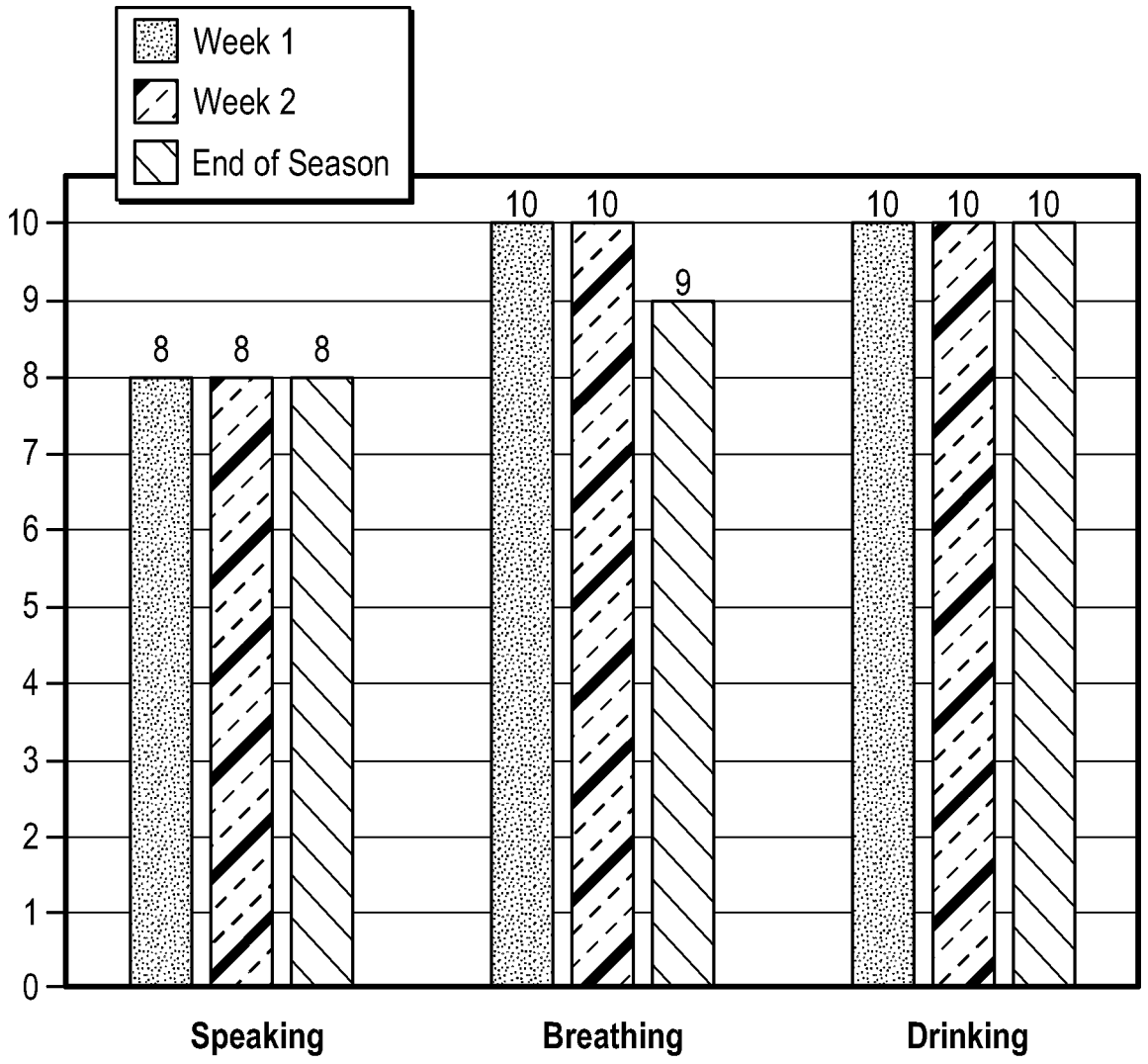
FIG. 22 is a chart summarizing survey results of how a girls softball pitcher perceived the ease of speaking, breathing, and drinking while wearing one embodiment of the mouth guard described herein. Results after one week are shown in black, after two weeks are shown in light grey, and at the end of the season in dark grey.
Figure 23:
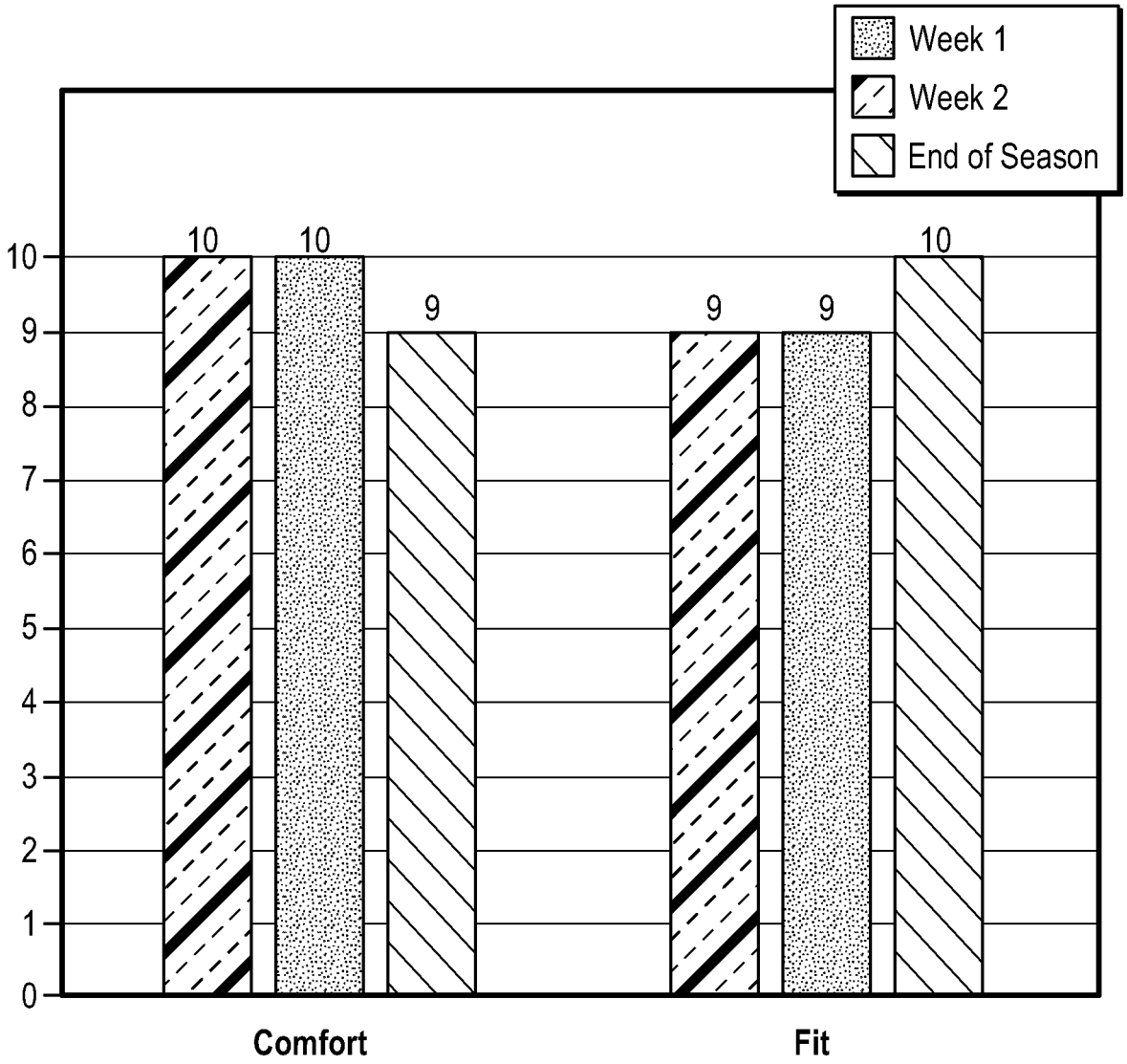
FIG. 23 is a chart summarizing survey results of how a girls softball pitcher perceived the comfort and fit of the mouth guard described herein. Results after one week are shown in black, after two weeks are shown in light grey, and at the end of the season in dark grey.

The next athlete to participate in a clinical study was a Girls' High School Softball Player. She played on a Girls' High School Softball Team as well as on an Elite Girls Traveling Softball Team. Mouth guard quality assessment and compliance studies were accomplished during the Spring and Summer Softball Seasons. As in the previous clinical studies, this athlete evaluated the new mouth guard for and ease of speaking, breathing, and drinking (FIG. 22) and fit and comfort (FIG. 23). The results were that the pitcher wore the new mouth guard each practice and game of the high school softball season and the spring/summer travelling softball season, did not stop to switch to wearing another type of mouth guard or stop wearing it, and wants to wear the mouth guard next season.

Professional Baseball Catcher

Figure 24:
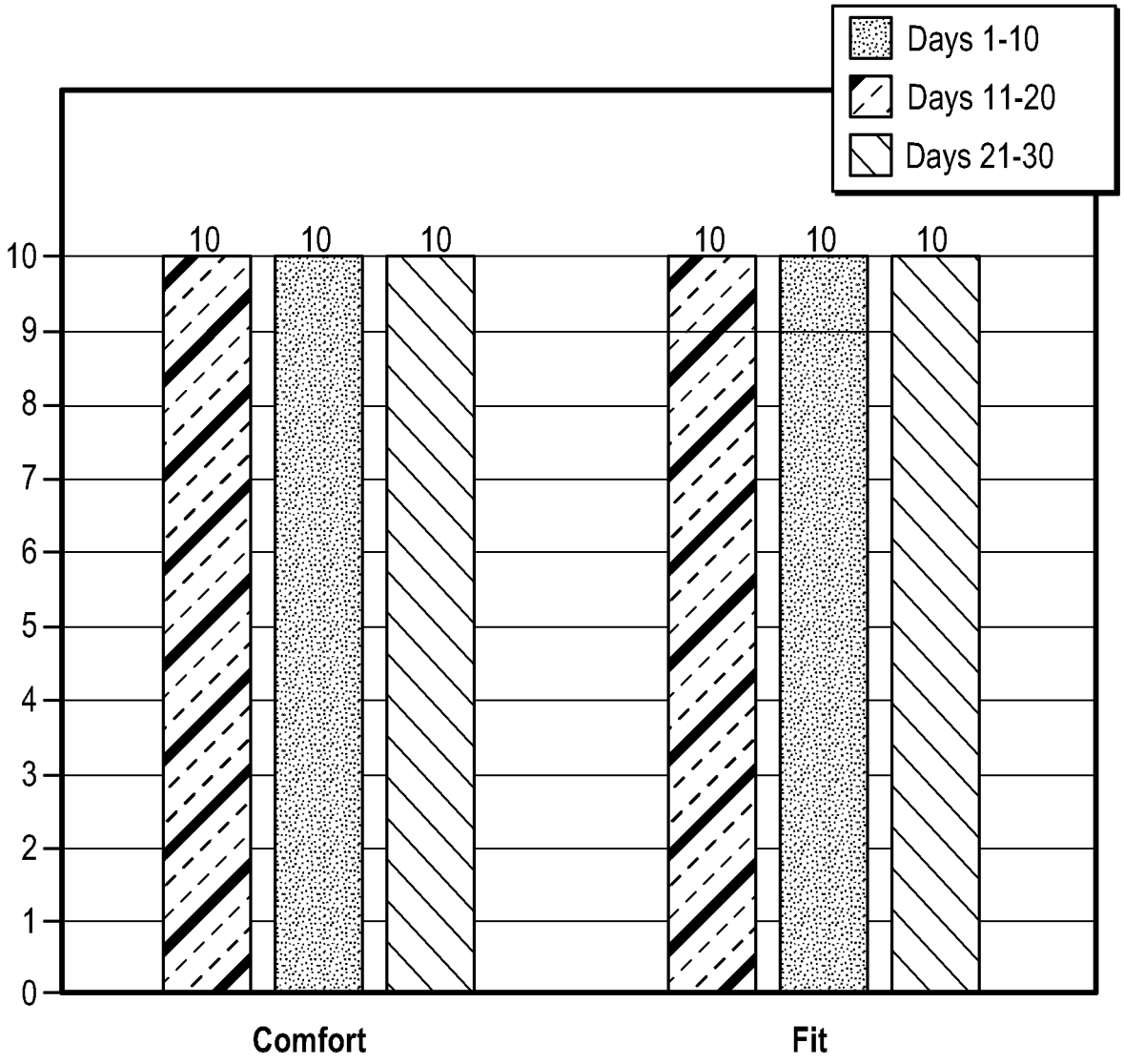
FIG. 24 is a chart summarizing survey results of how a professional baseball player perceived the comfort and fit of the mouth guard described herein. Results of Days 1-10 are shown in light grey, Days 11-20 are shown in dark grey, and at the end of the season in medium grey.
Figure 25:
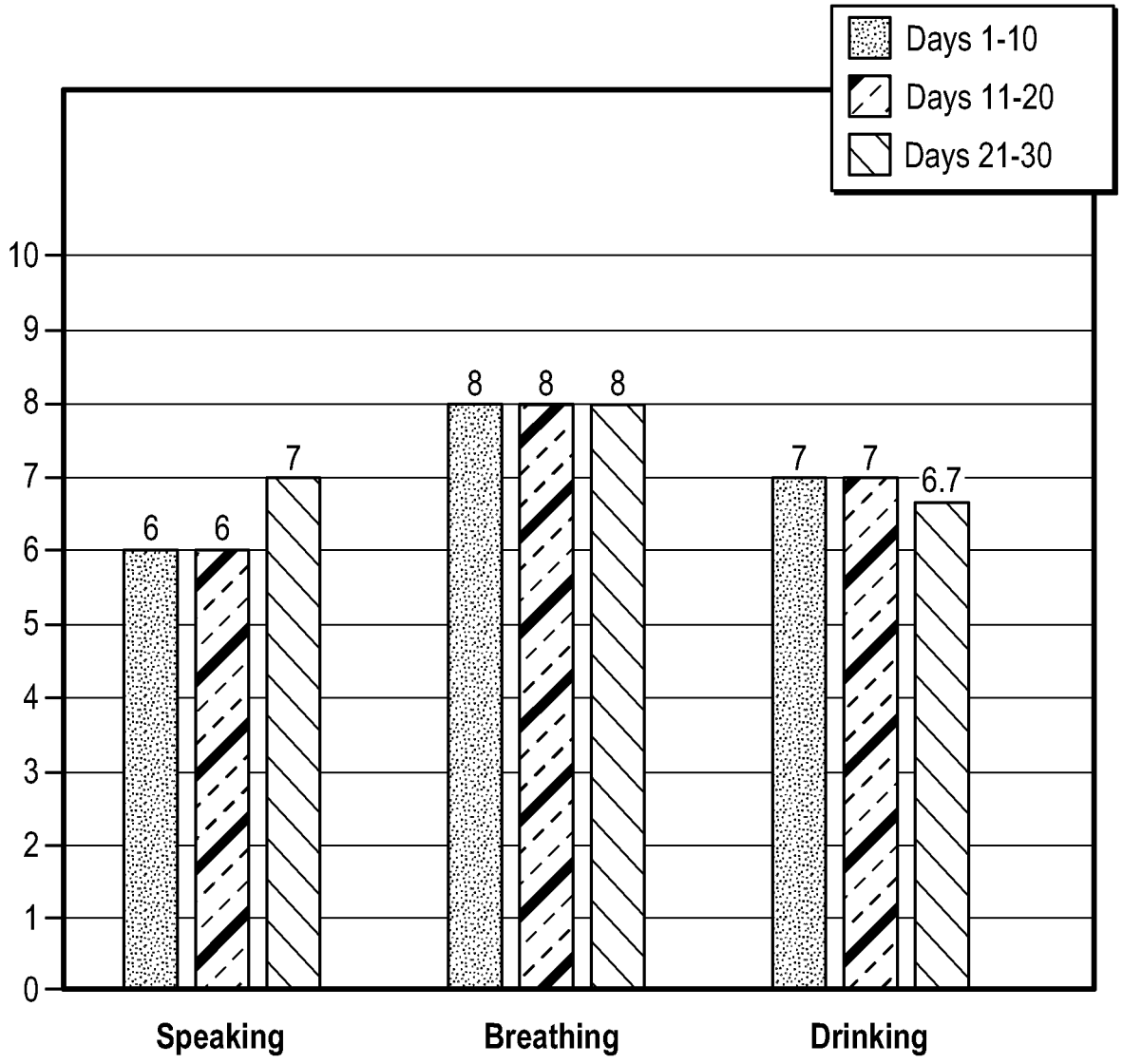
FIG. 25 is a chart summarizing survey results of how a professional baseball player perceived the ease of speaking, breathing, and drinking while wearing one embodiment of the mouth guard described herein. Results after Days 1-10 are shown in light grey, after Days 11-20 are shown in dark grey, and at the end of the season in medium grey.

The next athlete to participate in a clinical study was a catcher on a professional baseball team. Mouth guard quality assessment and compliance studies were accomplished during a 30-Day Clinical Trial during the professional baseball season. As in the previous clinical studies, this athlete evaluated the new mouth guard for fit and comfort (FIG. 24) and ease of speaking, breathing, and drinking (FIG. 25). The results were that he wore the new mouth guard each day of the clinical trial, he did not stop to switch to wearing another type of mouth guard or stop wearing it, he continued to wear the new mouth guard the remainder of the baseball season, and he wants to wear the mouth guard next season.

Alabama High School Football Player

Figure 26:
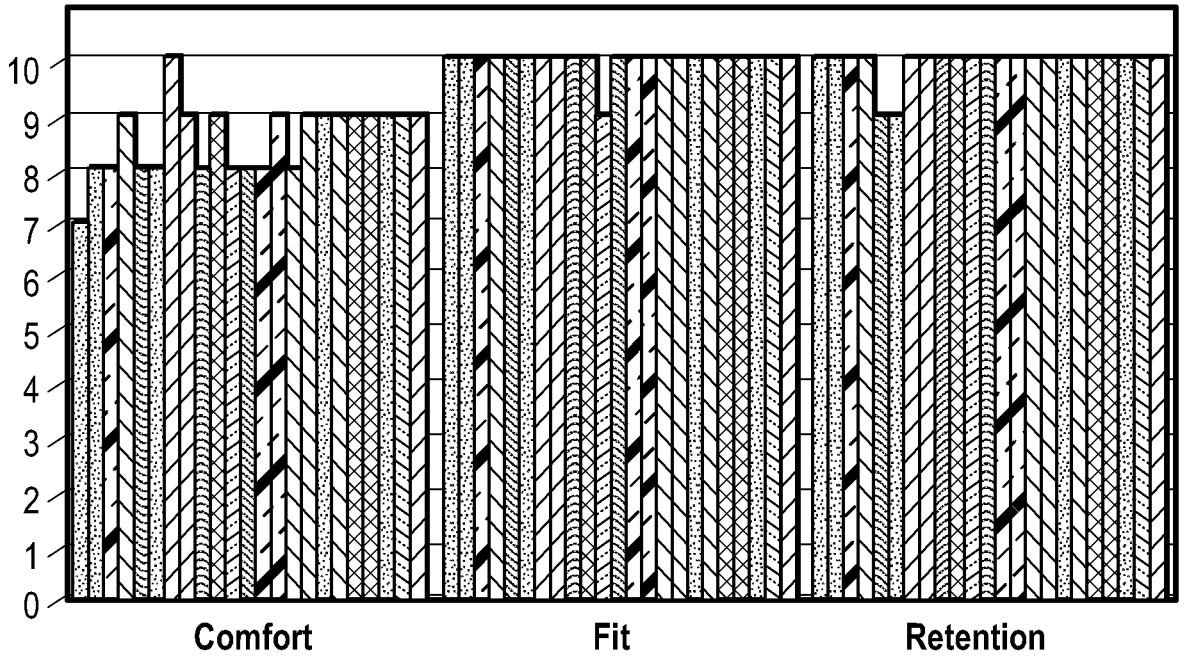
FIG. 26 is a chart summarizing survey results of how a high school football player perceived the comfort, fit and retention of the mouth guard described herein, over a 23 day trial. Each bar in the figure represents a single day of the trial.
Figure 27:
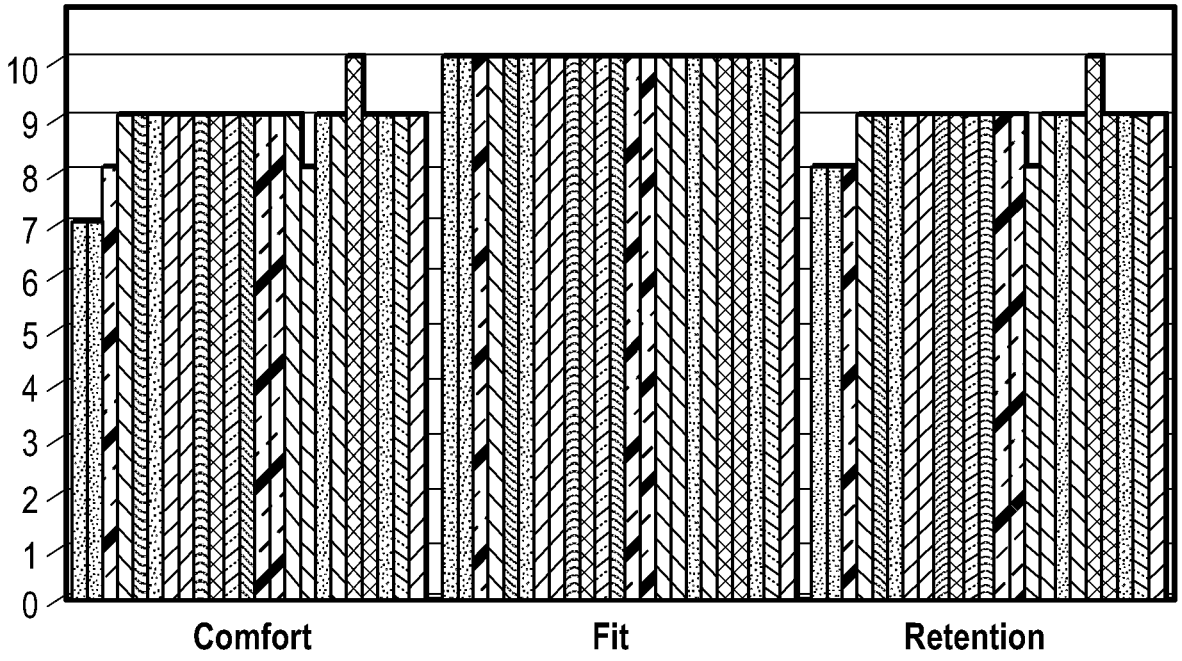
FIG. 27 is a chart summarizing survey results of how a high school football player perceived the ease of speaking, breathing, and drinking while wearing one embodiment of the mouth guard described herein, over a 23 day trial. Each bar in the figure represents a single day of the trial.

The final athlete to participate in a clinical study was a football player (defensive end) at an Alabama high school. Mouth guard quality assessment and compliance studies were accomplished during a 23-Day Clinical Trial during the high school football season. As in the previous clinical studies, this athlete evaluated the new mouth guard for the ease of speaking, breathing and drinking (FIG. 26) as well as comfort, fit and retention (FIG. 27). The results of the compliance study were that he wore the new mouth guard each practice and game during the 23-Day Clinical Trial, did not stop to switch to wear another type of mouth guard or stop wearing it, and wants to wear the mouth guard next season.

SUMMARY

Studies of this nature, a "Quality Assessment of Mouth guard Usage Study" and a "Compliance of Usage Study" do not appear in the literature. While many types of mouth guards are sold on the market today, no mouth guard has been evaluated in such a manner as this new mouth guard.

In conclusion, across a wide range of sports, and worn by both male and female athletes at the high school, college and professional levels, as well as extreme sports athletes, the new mouth guard described herein was extremely comfortable, fit well, and resulted in athletes being able to easily speak, breathe, and drink fluids.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A U-shaped custom-made mouth guard, comprising:

a) a pair of posterior portions of substantially uniform thickness, adapted to cover the lingual, front, and biting surfaces of all of the wearer's posterior teeth, and b an anterior portion interconnecting said posterior portions and configured to cover the lingual, front and biting surfaces of all of the wearer's anterior teeth, wherein sections of the anterior portion adapted to cover the front and biting surfaces of the anterior teeth are of substantially the same substantially uniform thickness as their respective posterior portions, and wherein the mouth guard has a decreased thickness on a portion of the lingual surface of the anterior portion, wherein the thickness of the mouth guard at the lingual surface of the anterior portion begins to change approximately one third of the way from the portions of the anterior portion configured to contact the wearer's incisal edge/cusp tip toward the portion of the anterior portion configured to contact the wearer's gingiva, such that the thickness at the portion of the anterior portion configured to contact the wearer's gingiva is between 25% and 35% of the thickness of the portion of the mouth guard configured to cover the front surface of the wearer's teeth, wherein all or part of the lingual surface of the mouth guard is scalloped, and wherein each of said posterior portions include an inner wall, an outer wall and a bottom wall, the inner wall terminating at the portion of the mouth guard adapted to contact the wearer's gum line so as to minimize discomfort to the wearer, wherein the mouth guard does not comprise an impact shield, and wherein only the lingual surface in the anterior portion of the mouth guard has a narrowing thickness.

2. The mouth guard of claim 1, wherein the change in thickness of the anterior portion from a) approximately one third of the way down the anterior portion, where the anterior portion is configured to contact the incisal edge/cusp tip toward where the anterior portion is configured to contact the gingiva, on the lingual surface of the anterior portion, is a substantially linear decrease in thickness.

3. The mouth guard of claim 1, wherein the change in thickness of the anterior portion from a) around approximately of the way down the anterior portion, where the anterior portion is configured to contact the incisal edge/cusp tip toward where the anterior portion is configured to contact the gingiva, on the lingual surface of the anterior portion, is a substantially concave curved profile.

4. The mouth guard of claim 1, wherein the mouth guard is a laminate comprising at least two layers.

5. The mouth guard of claim 1, wherein the mouth guard is prepared with a polymer that comprises a flavoring component and/or antibacterial component.

6. The mouth guard of claim 1, further comprising one or more anterior and/or buccal frenum reliefs.

7. A U-shaped custom-made mouth guard, comprising:

a) a pair of posterior portions of substantially uniform thickness, adapted to cover the lingual, front, and biting surfaces of all of the wearer's posterior teeth, and b) an anterior portion interconnecting said posterior portions and configured to cover the lingual, front and biting surfaces of all of the wearer's anterior teeth, wherein the sections of the anterior portion adapted to cover the front and biting surfaces of the anterior teeth are of substantially the same substantially uniform thickness as their respective posterior portions, and wherein the mouth guard has a decreased thickness on a portion of the lingual surface of the anterior portion, wherein the thickness of the mouth guard at the lingual surface of the anterior portion begins to change around 40-50% of the way from the portions of the anterior portion configured to contact the wearer's incisal edge/cusp tip toward the portion of the anterior portion configured to contact the wearer's gingiva, such that the thickness at the portion of the anterior portion configured to contact the wearer's gingiva is between 25% and 35% of the thickness of the portion of the mouth guard configured to cover the front surface of the wearer's teeth, wherein all or part of the lingual surface of the mouth guard is scalloped, and wherein each of said posterior portions include an inner wall, an outer wall and a bottom wall, the inner wall terminating at the portion of the mouth guard adapted to contact the wearer's gum line so as to minimize discomfort to the wearer, wherein the device mouth guard does not comprise an impact shield, and wherein only the lingual surface in the anterior portion of the mouth guard has a narrowing thickness.

8. The mouth guard of claim 7, wherein the change in thickness of the anterior portion from a) around 40-50% of the way down the anterior portion, where the anterior portion is configured to contact the incisal edge/cusp tip toward where the anterior portion is configured to contact the gingiva, on the lingual surface of the anterior portion, is a substantially linear decrease in thickness.

9. The mouth guard of claim 7, wherein the change in thickness of the anterior portion from a) around 40-50% of the way down the anterior portion, where the anterior portion is configured to contact the incisal edge/cusp tip toward where the anterior portion is configured to contact the gingiva, on the lingual surface of the anterior portion, is a substantially concave curved profile.

10. The mouth guard of claim 7, wherein the mouth guard is a laminate comprising at least two layers.

11. The mouth guard of claim 7, wherein the mouth guard is prepared with a polymer that comprises a flavoring component and/or antibacterial component.

12. The mouth guard of claim 7, further comprising one or more anterior and/or buccal frenum reliefs.

* * * * *